US011672350B2

(12) United States Patent
Graybill

(10) Patent No.: US 11,672,350 B2
(45) Date of Patent: Jun. 13, 2023

(54) MULTIPURPOSE ACCESSORY BAG FOR MULTI-MODE PORTABLE COLLAPSIBLE CHAIR

(71) Applicant: Robert Steven Graybill, Mount Pleasant, SC (US)

(72) Inventor: Robert Steven Graybill, Mount Pleasant, SC (US)

(73) Assignee: Crow Hill LLC, Mount Pleasant, SC (US)

( * ) Notice: Subject to any disclaimer, the term of this patent is extended or adjusted under 35 U.S.C. 154(b) by 24 days.

(21) Appl. No.: 17/187,610

(22) Filed: Feb. 26, 2021

(65) Prior Publication Data

US 2021/0204696 A1 Jul. 8, 2021

Related U.S. Application Data

(63) Continuation of application No. 16/892,205, filed on Jun. 3, 2020, now Pat. No. 11,369,202.
(Continued)

(51) Int. Cl.
*A47C 7/62* (2006.01)
*A45F 4/00* (2006.01)
(Continued)

(52) U.S. Cl.
CPC ..... *A47C 7/62* (2013.01); *A45C 9/00* (2013.01); *A45F 4/00* (2013.01); *A45F 4/02* (2013.01);
(Continued)

(58) Field of Classification Search
CPC ..... A45F 4/00; A45F 4/02; A45F 4/06; A45F 2004/026; A47J 41/0066; A47J 41/0061;
(Continued)

(56) References Cited

U.S. PATENT DOCUMENTS 2,080,252 A * 5/1937 Cook ..... D06F 95/004 383/92
2,137,427 A 11/1938 Campbell
(Continued)

FOREIGN PATENT DOCUMENTS

CH 208503 A 2/1940
CH 362189 A 5/1962
(Continued)

OTHER PUBLICATIONS

Communication of Supplementary European Search Report in related foreign Application No. PCT/US2018/016923 (EP 18 74 8634), dated Jul. 23, 2020, 5 pages.
(Continued)

*Primary Examiner* — Robert Canfield
(74) *Attorney, Agent, or Firm* — Craige Thompson; Thompson Patent Law; Timothy D. Snowden

(57) ABSTRACT

Various systems and methods relate to an adaptive chair system having (i) a stowed mode in which the members of the chair frame are contained within a compact flexible multi-function bag (MFB), and (ii) a deployed mode in which the MFB is adapted to releasably couple to an arm of the chair to provide a multipurpose accessory chamber. In an illustrative example, the MFB may, for example, fold in on itself in an accessory mode. The MFB may provide various utilities for hikers, for example, by providing a case to receive an inflatable bladder so as to form a pillow. The MFB may receive a thermal liner adapted to maintain, for example, food or beverage temperature. Various embodiments may advantageously provide a rugged, water resistant MFB system in an ultralight form factor that serves as a multipurpose accessory (e.g., to store items), yet provides a compact, adaptive chair frame containment.

16 Claims, 19 Drawing Sheets

Related U.S. Application Data

(60) Provisional application No. 62/890,941, filed on Aug. 23, 2019.

(51) Int. Cl.

| | |
|---|---|
| ***A47C 9/10*** | (2006.01) |
| ***A47C 4/02*** | (2006.01) |
| ***A47C 4/03*** | (2006.01) |
| ***A45F 4/06*** | (2006.01) |
| ***A45F 4/02*** | (2006.01) |
| ***A45C 9/00*** | (2006.01) |
| *A45B 5/00* | (2006.01) |
| *A47G 9/10* | (2006.01) |

(52) U.S. Cl.
CPC ..... *A45F 4/06* (2013.01); *A47C 4/022* (2013.01); *A47C 4/03* (2013.01); *A47C 7/622* (2018.08); *A47C 7/624* (2018.08); *A47C 9/10* (2013.01); *A45B 5/00* (2013.01); *A45F 2004/026* (2013.01); *A47G 9/1027* (2013.01)

(58) Field of Classification Search
CPC ..... A47J 41/0077; A47C 9/10; A47C 7/62; A47C 7/622; A47C 7/624; A45C 9/00
USPC ..... 190/1; 206/315.11; 297/188.14, 188.18, 297/188.2; 383/3, 4, 16, 22–24, 72–76, 383/100, 111, 113, 901, 906; 224/148.2, 224/148.3, 575, 577, 581, 585; 220/739
See application file for complete search history.

(56) References Cited

U.S. PATENT DOCUMENTS

| | | | | |
|---|---|---|---|---|
| 2,761,480 | A * | 9/1956 | Tames | D06F 95/004 383/6 |
| 2,766,813 | A | 10/1956 | Kay | |
| 4,184,711 | A | 1/1980 | Wakimoto | |
| 4,258,951 | A | 3/1981 | Groom | |
| 4,420,097 | A * | 12/1983 | Motsenbocker | A45F 3/16 222/215 |
| 4,547,015 | A | 10/1985 | Wakimoto | |
| 4,605,261 | A | 8/1986 | Lee | |
| 4,673,211 | A | 6/1987 | Hoffman | |
| 4,786,082 | A | 11/1988 | Swietlik | |
| 4,914,768 | A | 4/1990 | Howard | |
| 5,054,849 | A | 10/1991 | Hoff | |
| 5,362,130 | A | 11/1994 | Hoffman | |
| 5,499,857 | A | 3/1996 | Lynch, Jr. | |
| 5,709,428 | A | 1/1998 | Hugghins | |
| 5,921,621 | A | 7/1999 | Cook et al. | |
| 5,927,798 | A | 7/1999 | Ahn | |
| 5,941,640 | A * | 8/1999 | Thatcher | A45F 3/04 383/30 |
| 6,000,752 | A * | 12/1999 | Shyr | A47C 4/38 297/188.08 |
| 6,036,262 | A * | 3/2000 | Shahid | A47C 7/66 297/188.14 |
| 6,267,244 | B1 * | 7/2001 | Witt | H02G 11/02 383/33 |
| 6,371,553 | B1 | 4/2002 | Tang | |
| 6,629,722 | B1 * | 10/2003 | Tang | A47C 4/286 297/188.2 |
| 6,644,854 | B2 * | 11/2003 | Lien | A45F 3/20 383/89 |
| 6,722,533 | B2 * | 4/2004 | Skillern | A45F 3/20 222/529 |
| 6,820,927 | B2 * | 11/2004 | Isom | A47C 7/282 297/16.2 |
| 6,926,355 | B2 * | 8/2005 | Le Gette | A47C 7/66 297/16.2 |
| 7,083,331 | B2 * | 8/2006 | Nykoluk | A45C 3/00 383/2 |
| 8,006,711 | B2 | 8/2011 | Pietrzak et al. | |
| 8,454,084 | B2 | 6/2013 | Lah | |
| 8,550,713 | B2 * | 10/2013 | Schwarz | B65D 33/14 383/41 |
| 8,887,962 | B2 * | 11/2014 | Herivel | A45F 3/20 383/68 |
| 8,894,139 | B1 | 11/2014 | Coffey | |
| 8,899,686 | B1 | 12/2014 | Kim | |
| 9,241,550 | B2 * | 1/2016 | James | A45C 11/00 |
| 9,326,612 | B2 | 5/2016 | Kim | |
| 9,854,882 | B1 | 1/2018 | Peck | |
| 10,285,503 | B2 * | 5/2019 | Graybill | A45B 5/00 |
| 10,531,740 | B2 | 1/2020 | Graybill | |
| 11,166,530 | B1 | 11/2021 | Wilson, Jr. | |
| D955,132 | S * | 6/2022 | Sullivan | D6/368 |
| 2002/0012480 | A1 * | 1/2002 | Konno | A45F 3/04 383/117 |
| 2002/0088059 | A1 * | 7/2002 | Reeves | A45F 4/02 5/653 |
| 2003/0011217 | A1 * | 1/2003 | Le Gette | A47C 4/286 297/16.2 |
| 2003/0094836 | A1 | 5/2003 | Chen | |
| 2004/0066064 | A1 | 4/2004 | Neely et al. | |
| 2004/0140696 | A1 | 7/2004 | Grace | |
| 2007/0252416 | A1 | 11/2007 | Park et al. | |
| 2008/0169688 | A1 | 7/2008 | Funderburg | |
| 2009/0039685 | A1 | 2/2009 | Zernov | |
| 2009/0230736 | A1 | 9/2009 | Homans | |
| 2010/0260443 | A1 * | 10/2010 | Ramirez | B65D 33/28 383/75 |
| 2011/0181078 | A1 | 7/2011 | Kelly et al. | |
| 2011/0243647 | A1 | 10/2011 | Sohn | |
| 2012/0104805 | A1 | 5/2012 | Lah | |
| 2012/0168574 | A1 * | 7/2012 | Urbanczyk | B65F 1/10 248/99 |
| 2012/0241463 | A1 * | 9/2012 | Zimmerman | B65D 85/18 221/199 |
| 2013/0048686 | A1 * | 2/2013 | Mcdonald | A45C 9/00 383/105 |
| 2014/0093188 | A1 * | 4/2014 | Bush | B65D 33/02 383/32 |
| 2014/0262873 | A1 * | 9/2014 | Lorentz | A45F 3/02 206/315.1 |
| 2014/0375104 | A1 | 12/2014 | Kim | |
| 2015/0091335 | A1 | 4/2015 | Lee | |
| 2015/0313330 | A1 | 11/2015 | Stevens et al. | |
| 2015/0374131 | A1 | 12/2015 | Kim | |
| 2016/0113402 | A1 | 4/2016 | Lee | |
| 2016/0113403 | A1 * | 4/2016 | Lee | A47C 9/105 297/16.2 |
| 2017/0311723 | A1 | 11/2017 | Lenhart | |
| 2018/0035806 | A1 | 2/2018 | Yang | |
| 2018/0070728 | A1 | 3/2018 | Humphreys et al. | |
| 2018/0094449 | A1 * | 4/2018 | Batushanskiy | A45F 4/04 |
| 2019/0104850 | A1 | 4/2019 | Frankel et al. | |
| 2019/0159577 | A1 * | 5/2019 | Tamberino | B65D 33/28 |
| 2020/0087035 | A1 * | 3/2020 | Reinsfelder | A45F 3/02 |
| 2020/0214451 | A1 * | 7/2020 | Garrison | A47C 4/28 |
| 2022/0000268 | A1 | 1/2022 | Davis | |

FOREIGN PATENT DOCUMENTS

| | | | |
|---|---|---|---|
| CN | 2107161 | U | 6/1992 |
| CN | 200959890 | Y | 10/2007 |
| CN | 202874555 | U | 4/2013 |
| EP | 0209955 | A2 | 1/1987 |
| EP | 0997090 | A1 | 5/2000 |
| FR | 830436 | A | 7/1938 |
| GB | 694556 | A | 7/1953 |
| GB | 767316 | A | 1/1957 |
| GB | 2025213 | A | 1/1980 |
| WO | 2016055280 | A1 | 4/2016 |
| WO | 2016065981 | A1 | 5/2016 |
| WO | 2018145039 | A1 | 8/2018 |

OTHER PUBLICATIONS

(56) References Cited

OTHER PUBLICATIONS

Helinox, "Chair Two," Helinox, [retrieved from the internet Jan. 12, 2022] <https://helinox.com/products/chair-two>.
Helinox, "Helinox Chair Two Ultralight, High-Back, Collapsible Camping Chair, Black," Amazon.com, Feb. 1, 2017, [retrieved from the internet Jan. 12, 2022] <https://www.amazon.com/Helinox-Chair-Camping-Black-Size/dp/B01MQVBU8Z/ref=sr_1_2?keywords=helinox+chair+two&qid=1642038450&sr=8-2>.
Mountainsmith, "Mountainsmith Sling Back Chair Anvil Grey," Amazon.com, Dec. 7, 2016 [retrieved from the internet Jan. 22, 2022] <https://www.amazon.com/gp/product/B01N7FXHSU/ref=as_li_tl?ie=UTF8&camp=1789&creative=9325&creativeASIN=B01N7FXHSU&linkCode=as2&tag=indoorsycampe-20&linkId=a0463672c146490ceaf793db81f635f4<.
Mulibex, "CAPRA | Freakishly Strong, Adaptive Light Chair System," Jul. 21, 2021, Kickstarter, [retrieved from the internet Apr. 27, 2022], <https://www.kickstarter.com/projects/mulibex/capra-freakishly-strong-adaptive-light-chair-system?ref=discovery&term=mulibex>.
Mulibex, "Innovative Ultra Light Camp Chairs," Mar. 7, 2018, Kickstarter, [retrieved from the internet Apr. 27, 2022], <https://www.kickstarter.com/projects/653830043/hybrid-light-camp-chairs-mulibex-made-in-america?ref=discovery&term=mulibex>.
Mulibex, "Meet CAPRA A Freakishly Strong, Adaptive Light Chair System," Jun. 6, 2020, YouTube, [retrieved from the internet Apr. 27, 2022], <https://youtu.be/812siscGBkU>.
Mulibex, "Multi-Use Adaptable Light Gear," Sep. 18, 2019, YouTube, [retrieved from the internet Apr. 27, 2022], <https://www.youtube.com/watch?v=x71xhPoyW14>.
Mulibex, "There's Adventure and Healing in Nature," YouTube, Sep. 23, 2019, [retrieved from the internet Apr. 27, 2022], <https://www.youtube.com/watch?v=_XRf_P1lt4&t=18s>.
Mulibex, "Beach Demo—Transforming the CAPRA into the Seagot Islander," Oct. 8, 2019, YouTube, [retrieved from the internet Apr. 27, 2022].
Mulibex, "Watch It Transform—Adaptive light Chair System," Mar. 30, 2020, YouTube, [retrieved from the internet Apr. 27, 2022].
International Preliminary Report on Patentability and Written Opinion of the International Searching Authority in related foreign Application No. PCT/US2018/016923, dated Aug. 15, 2019, 6 pages.
International Search Report and Written Opinion in Related PCT Application No. PCT/US18/16923, dated Apr. 24, 2018, 7 pages.

* cited by examiner

MULTIPURPOSE ACCESSORY BAG FOR MULTI-MODE PORTABLE COLLAPSIBLE CHAIR

CROSS-REFERENCE TO RELATED APPLICATIONS

This application is a continuation of, and claims priority to, U.S. application Ser. No. 16/892,205, titled "Adaptive Chair with Multi-Function Bag," filed by Robert Steven Graybill, on Jun. 3, 2020, which application claims the benefit of U.S. Provisional Application Ser. No. 62/890,941, titled "Crossover Chair, Bivvy/Tent, and Assorted Outdoor Gear," filed by Robert Steven Graybill, on Aug. 23, 2019.

This application relates to the subject matter of:

- U.S. application Ser. No. 15/888,994, titled "Collapsible Chair," filed by Robert Steven Graybill, on Feb. 5, 2018.
- U.S. Provisional Patent Application Ser. No. 62/454,112, titled "Portable Collapsible Trekking Pole Chair," filed by Robert Steven Graybill, on Feb. 3, 2017.
- U.S. Provisional Patent Application Ser. No. 62/535,709, titled "Collapsible Alpine Chair," filed by Robert Steven Graybill, on Jul. 21, 2017.
- U.S. Provisional Patent Application 62/620,305, titled "Muhl and Capra Chairs," by Robert Steven Graybill, on Jan. 22, 2018.

This application incorporates the entire contents of the foregoing application(s) herein by reference.

TECHNICAL FIELD

Various embodiments relate generally to outdoor gear.

BACKGROUND

Chairs are pieces of furniture in which people may sit. A chair may include legs, a seat, and a back. The number of legs on a chair may be three, four, or more legs. A seat of a chair may be cushioned or non-cushioned. The back of a chair may be inclined or may form a 90-degree angle with respect to a horizontal chair seat. There are different varieties of chairs. For example, a chair with arms may be referred to as an armchair. A chair with upholstery, reclining action, and a fold-out footrest may be referred to as a recliner. A permanently fixed chair in an airplane may be referred to as an airline seat. A chair used in an automobile may be referred to as a car seat. A chair with wheels may be referred to as a wheelchair.

Outdoor activities are a pastime for many people who enjoy being active and present out in nature. Some people may spend at least a portion of their leisure time hiking in the woods, lounging on a beach, boating on a lake, or playing at a park, for example. When people participate in recreational activities like the ones described above, they often like to bring various utilitarian devices and leisure-facilitating consumer goods that may increase and/or augment the enjoyment of these recreational activities. For example, some people bring floats or paddle boards to a beach or a river for recreational enjoyment. Some people may receive significant satisfaction from carrying ice chests filled with cool drinks to an outdoor concert. Yet other people may spend their leisure time camping in the woods using an array of utilitarian items and survival gear.

SUMMARY

Various systems and methods relate to an adaptive chair system having (i) a stowed mode in which the members of the chair frame are contained within a compact flexible multi-function bag (MFB), and (ii) a deployed mode in which the MFB is adapted to releasably couple to an arm of the chair to provide a multipurpose accessory chamber. In an illustrative example, the MFB may, for example, fold in on itself in an accessory mode. The MFB may provide various utilities for hikers, for example, by providing a case to receive an inflatable bladder so as to form a pillow. The MFB may receive a thermal liner adapted to maintain, for example, food or beverage temperature. Various embodiments may provide multifunctional services such as sun/rain canopy and footrest, for example, using the adaptive chair system in an ultralight form factor that is strong yet compact in the stowed mode.

BRIEF DESCRIPTION OF THE DRAWINGS

FIG. 7A depicts a top plan view of an exemplary fluid filter core/insert for use with an exemplary stowage bag, while

FIGS. 13A and 13B depict side perspective and side elevational views, respectively, of an exemplary collapsible chair frame deployed as a multi-functional sun canopy/rain cover on an exemplary backpack (without the cover), while

Like reference symbols in the various drawings indicate like elements.

DETAILED DESCRIPTION OF ILLUSTRATIVE EMBODIMENTS

Figures 1A, 1B, 1C:
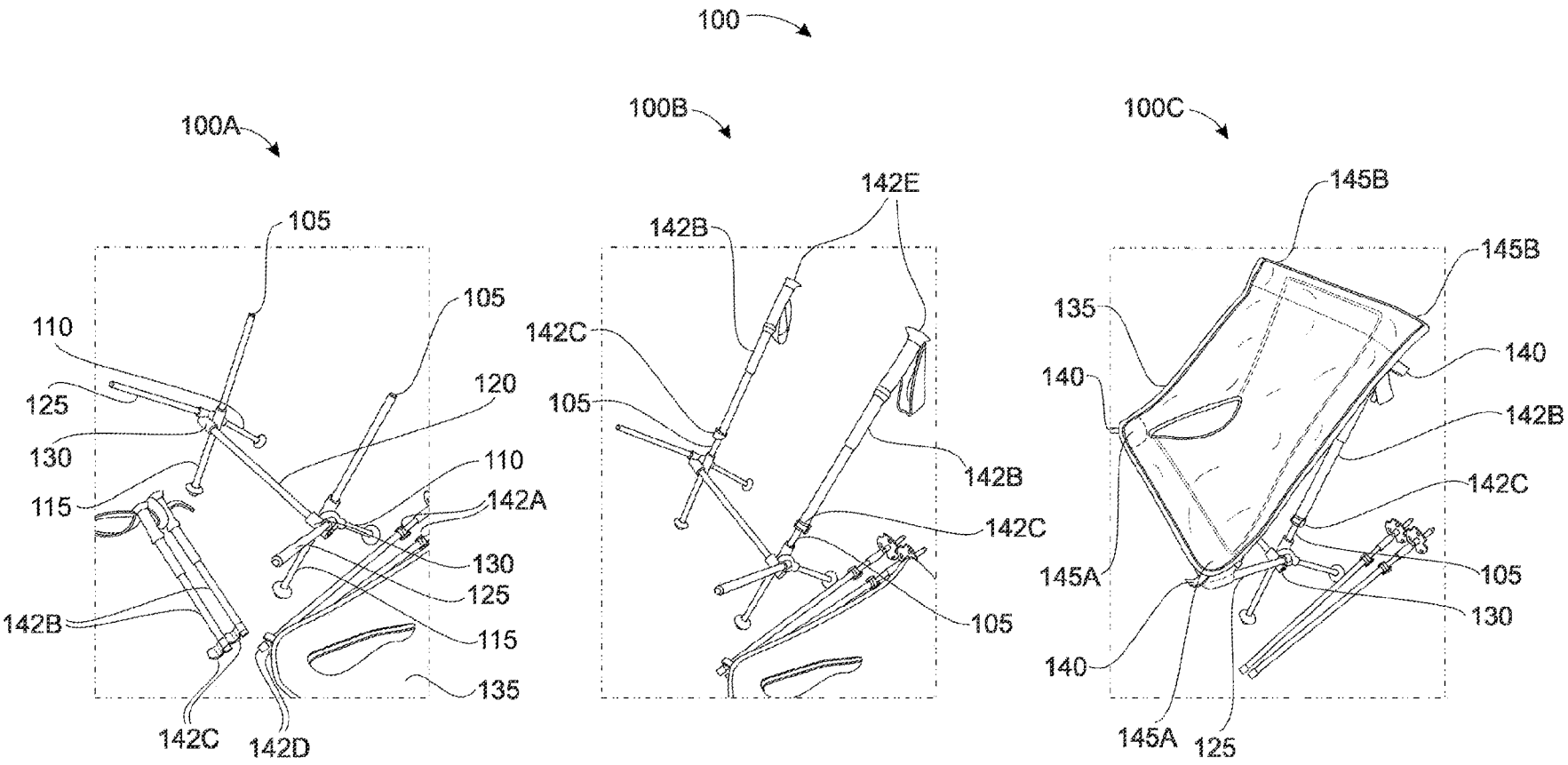
FIGS. 1A, 1B, and 1C depict perspective views illustrating a process of setting up a first exemplary collapsible crossover chair.

FIGS. 1A, 1B, and 1C depict perspective views illustrating a process of setting up a first exemplary collapsible crossover chair. Various structures, functions, and aspects of exemplary crossover chairs disclosed herein may be similar or identical to structures, functions, and aspects of collapsible chairs disclosed in U.S. application Ser. No. 15/888,994, titled "Collapsible Chair," filed by Robert Steven Graybill, on Feb. 5, 2018, which shares common inventorship with this application, and the entire contents of which are hereby incorporated by reference herein. For example, and as shown in FIG. 1A, a first exemplary collapsible crossover chair 100 includes a pair of back chair supports 105, a pair of back legs 110, a pair of front legs 115, a collapsible lateral rod 120, a pair of front chair supports 125, a pair of mechanical junctions 130, a flexible chair seat 135, and gear loops 140 (e.g., similar to collapsible Capra™-chair 200 disclosed in U.S. application Ser. No. 15/888,994). In an illustrative embodiment, each mechanical junction 130 may be (1) shock-cord-coupled with a respective back leg 110, front leg 115, front chair support 125, and back chair support 105, and (2) fixedly coupled to a respective lateral end of the collapsible lateral rod 120. In various implementations, the back chair supports 105 extend approximately the same height above the ground (e.g., about 0.5, 1, or about 2 inches) as the front chair supports 125 when the chair 100 is deployed on a flat surface. The vertical height of the distal ends of the back chair supports 105 may, as depicted in the example of FIG. 1A, extend slightly above (e.g., about 0.5, 1, 2, 3, 4, 5, or about 6 inches or more) the vertical height of the distal ends of the front chair supports 125.

Figure 2B:
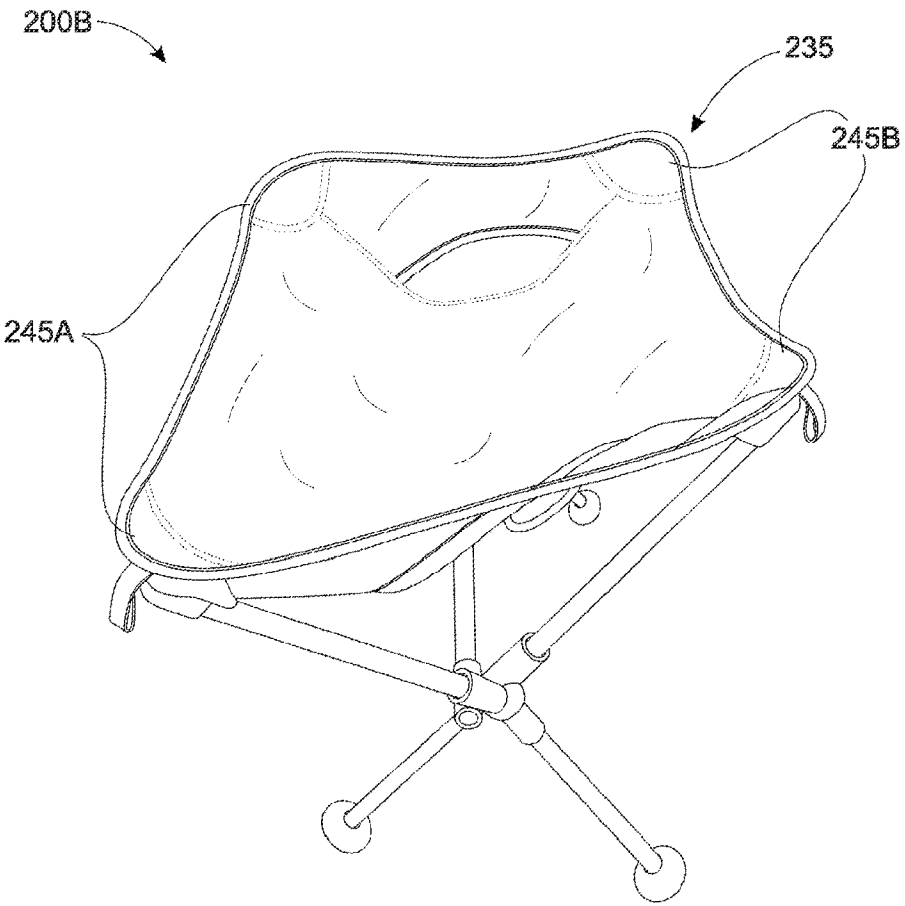
FIGS. 2A and 2B depict perspective views illustrating a second exemplary collapsible crossover chair.

In the first step of the process shown in FIGS. 1A-1C, the chair 100 is assembled, as shown in FIG. 1A (with assembly details similar to the assembly shown in FIGS. 2A-2F of U.S. application Ser. No. 15/888,994). Next, a pair of trekking poles are disassembled into a pair of lower pole segments 142A and a pair of upper pole segments 142B. Each of the upper (handle) pole segments 142B are assembled to respective distal ends of the back chair supports 105, as shown in FIG. 1B. The upper pole segments 142B may each have a mechanical lock 142C (e.g., a clamp lock) located at a proximal end, which may be used to fixedly, yet releasably couple each upper pole segment 142B to a respective back chair support 105. Next, and as shown in FIG. 1C, a flexible seat cover 140 is placed over the ends of each of the rods of the chair, thus converting the chair frame (shown in FIG. 1A) into the first exemplary collapsible crossover chair 100. More specifically, a pair of laterally-spaced top pockets 145B of the flexible chair seat 135 are configured to receive distal ends of associated poles segments 142B, while a pair of laterally-spaced front pockets 145A of the flexible chair seat 135 are configured to receive distal ends of associated front chair supports 125 (e.g., similar to the collapsible chair shown in FIGS. 4A and 4B of U.S. application Ser. No. 15/888,994). The first exemplary crossover chair 100 may therefore advantageously be selectively deployed as either a full-sized chair with an upright chair back (as shown in FIG. 1C, referred to herein as a "first mode" or a "full-sized (chair) mode" of a crossover chair), or as a smaller and lower profile recon seat without an upright chair back (as shown in FIG. 2B, referred to herein as a "second mode" or a "low-profile/recon (seat) mode" of a crossover chair), all using the same frame depicted in FIG. 1A (and also detailed in FIG. 2A, described below).

In some examples, the element 142C may instead be a safety stop 142C. The safety stop may be a cylinder (e.g., about 3.5 inches long) that slides over the tube segments of the chair supports 105 prior to putting the trek pole handle segment onto the chair supports 105. The safety stop may act as a mechanical stop, and may also be used to wrap duct tape around (which is a great place to store for easy access, especially if doing blister work). For example, a user may sit in the seat and pull off sections of duct tape to repair the user's foot. The safety stop can also be used to accurately set the height of 142B consistently and repeatably prior to placing the flexible seat cover 140 onto the assembled frame.

Figure 2A:
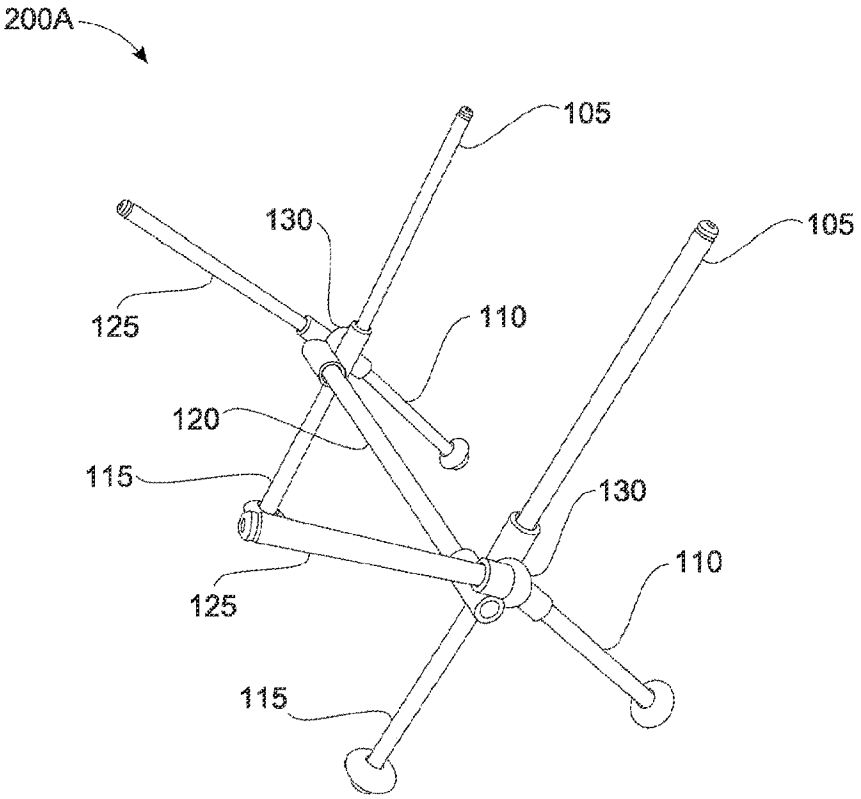

FIGS. 2A and 2B depict perspective views illustrating a second exemplary collapsible crossover chair. As explained above, the chair frame 200A may be combined with the pair of upper pole segments 142B to form a full-sized, upright back chair (as shown in FIG. 1C), or may simply be used in a standalone manner as a smaller and lower profile recon seat 200, having a (minimal) chairback that extends vertically to only about a user's waist level when the user is sitting in the recon seat 200 (as shown in FIG. 2B). More specifically, as shown in FIG. 2A, chair frame 200A includes the pair of back chair supports 105, the pair of back legs 110, the pair of front legs 115, the collapsible lateral rod 120, the pair of front chair supports 125, and the pair of mechanical junctions 130. The chair frame 200A may be converted into a low-profile recon seat by applying a recon-style flexible seat cover 235 to the frame 200A. Similar to the full-size flexible seat cover 135 discussed with reference for FIGS. 1A-1C, the recon-style seat cover 235 includes front and back pockets 245A, 245B configured to releasably receive distal ends of associated front chair supports 125 or back chair supports 105.

The light recon seat cover 235 is shown as having a significantly smaller profile than the full-sized chair 135 shown in FIG. 1, with less overall surface area. When the assembled chair frame 200A is placed on a flat surface, the distal ends of the pair of back chair supports 105 may vertically extend slightly above (e.g., about 0.5, 1, 1.5, 2, 2.5, 3, 4, or about 5 inches or more) the distal ends of the pair of front chair supports 125. An angle formed between a given front chair support and associated back chair support may be greater than 90 degrees (e.g., about 95, 100, 105, or about 115 degrees or more). Furthermore, when the recon seat 200 is assembled and stood upright on flat ground (as shown in FIG. 2B), the front two lateral points of the light recon seat cover 235 (associated with front pockets 245A) may have a vertical height that is slightly lower than the vertical height of back two lateral points of the light recon seat cover 235 (associated with back pockets 245B). For example, the vertical height difference between the front lateral point pairs and the back lateral point pairs may be about 0.5, 1, 1.5, 2, 2.5, 3, 4, or about 5 inches or more.

Figure 3:
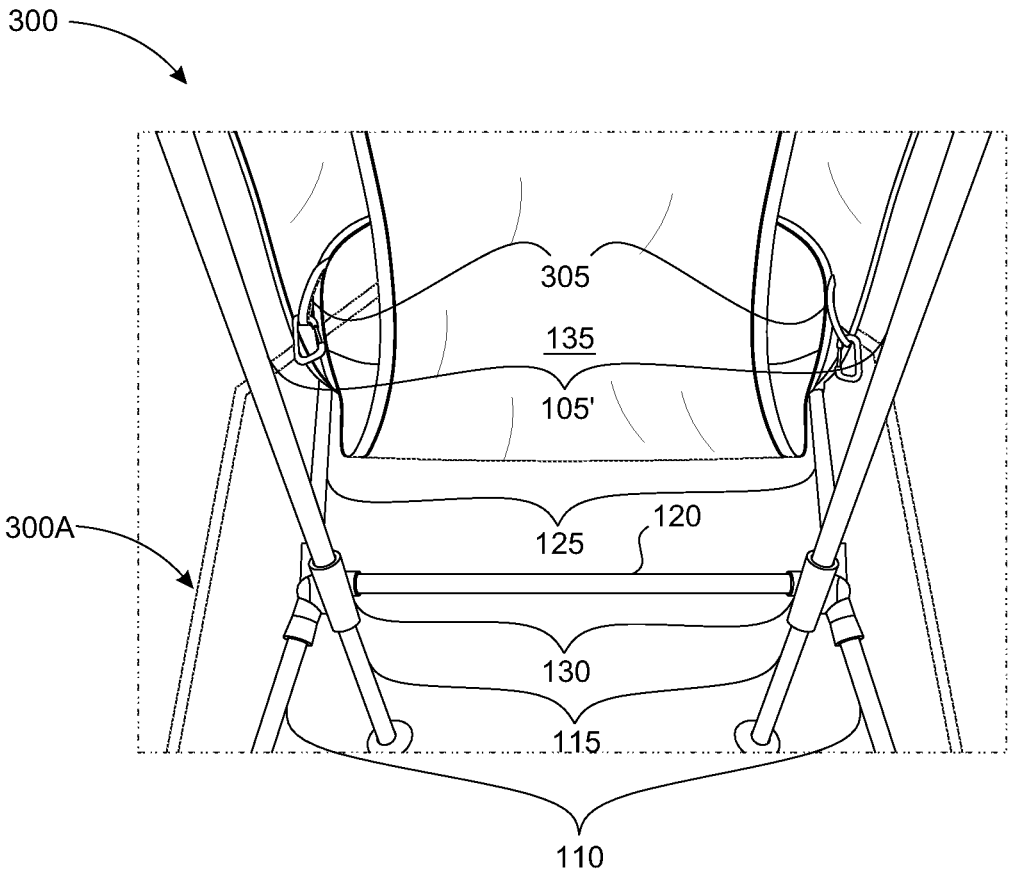
FIG. 3 depicts a back view of an exemplary chair having gear loops on the arm portions of the chair.

FIG. 3 depicts a back view of an exemplary chair having gear loops on the arm portions of the chair. An exemplary full-sized chair 300 may be similar to the collapsible Capra™-chair 200 disclosed in U.S. application Ser. No. 15/888,994. For example, may include the pair of back legs 110, the pair of front legs 115, the collapsible lateral rod 120, the pair of front chair supports 125, the pair of mechanical junctions 130, and the flexible chair seat 135. The chair 300 may also include a pair of back chair supports 105', that extend longer in length than the pair of back chair supports 105 depicted in FIG. 2A. The chair 300 may therefore have a chair frame 300A that differs from the chair frame 200A shown in FIG. 2A, in at least the respect that each of the supports 105' extend significantly longer than (e.g., about twice the length of) each of the supports 105. For example, a support 105' may extend to a length that is about equal to the length of the assembled combination of support 105 and upper pole segment 142E, as shown in FIG. 1B, such that the chair 300 may have an assembled profile and footprint similar to the profile and footprint of assembled crossover chair 100 (shown in FIG. 1C).

The full-sized chair 300 includes at least one gear loop 305 located on lateral sides of the collapsible chair. A first gear loop (not shown) may be located at a front lateral edge of the chair (e.g., similar to the front loops 140 shown in FIG. 1C), while a second gear loop 305 may be located on a mid-lateral side (inner arm) of the chair 300. As shown in FIG. 3, a pair of arm gear loops 305 are located at a portion along the arm section of the chair 300. In the depicted embodiment, each gear loop 305 is fixed at an inner-facing surface of an associated arm rest of the flexible chair seat 135. The arm loops 305 may beneficially allow for other types of accessories to be coupled to the chair 300. Furthermore, other chairs/seat covers disclosed herein (e.g., the chair 100 or the seat 200) may include the arm gear loops 305, and being outfitted similarly to the illustrative depiction of FIG. 3.

Figure 4C:
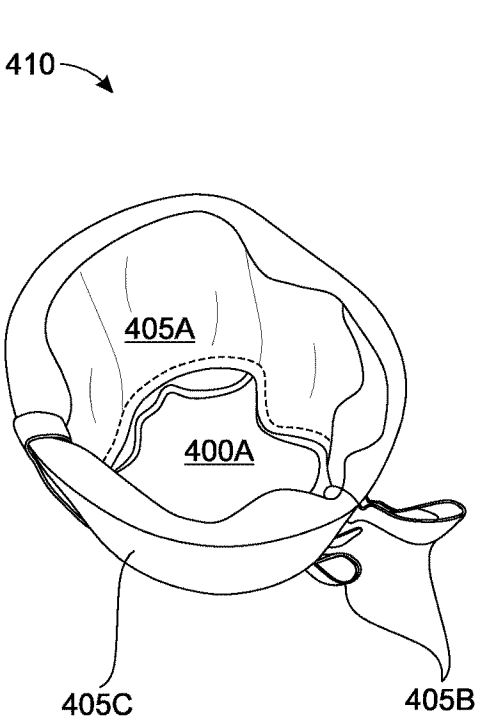
FIGS. 4A, 4B, and 4C depict side and top perspective views of an exemplary stowage bag for a collapsible chair, including an exemplary thermal insulation core/insert.
Figure 4B:
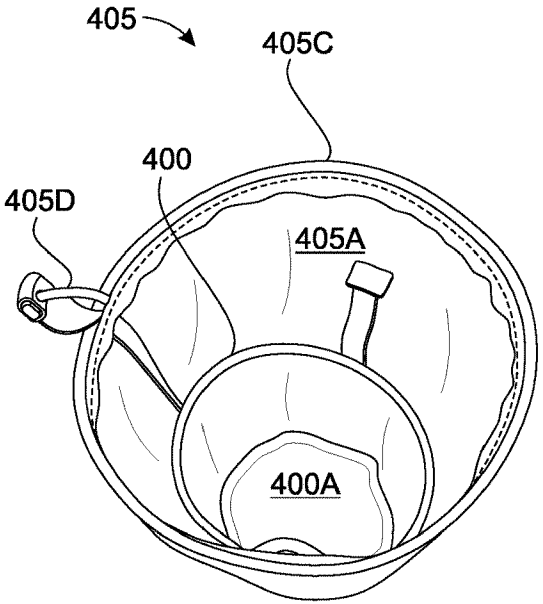
Figure 4A:
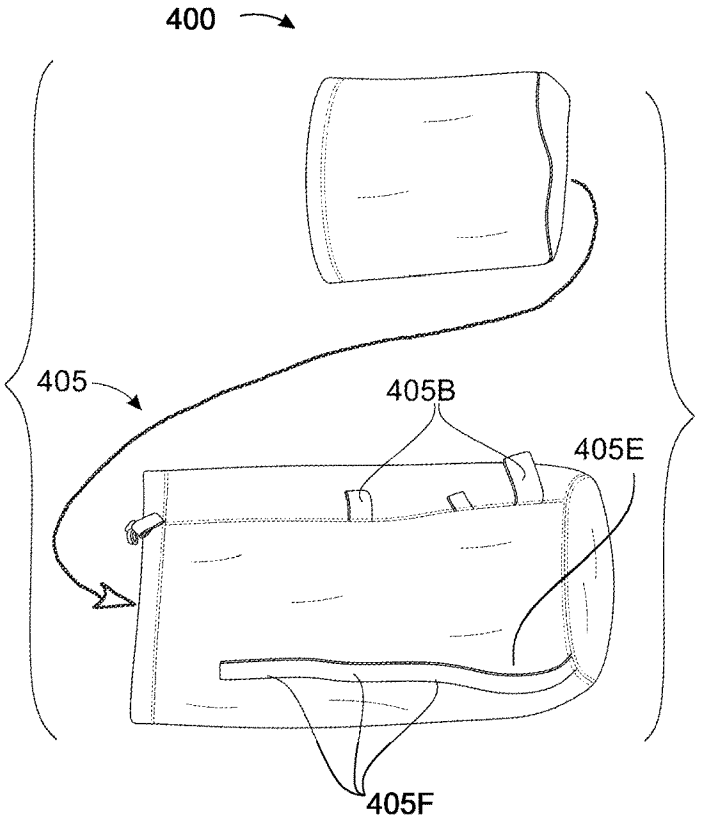
Figure 4D:
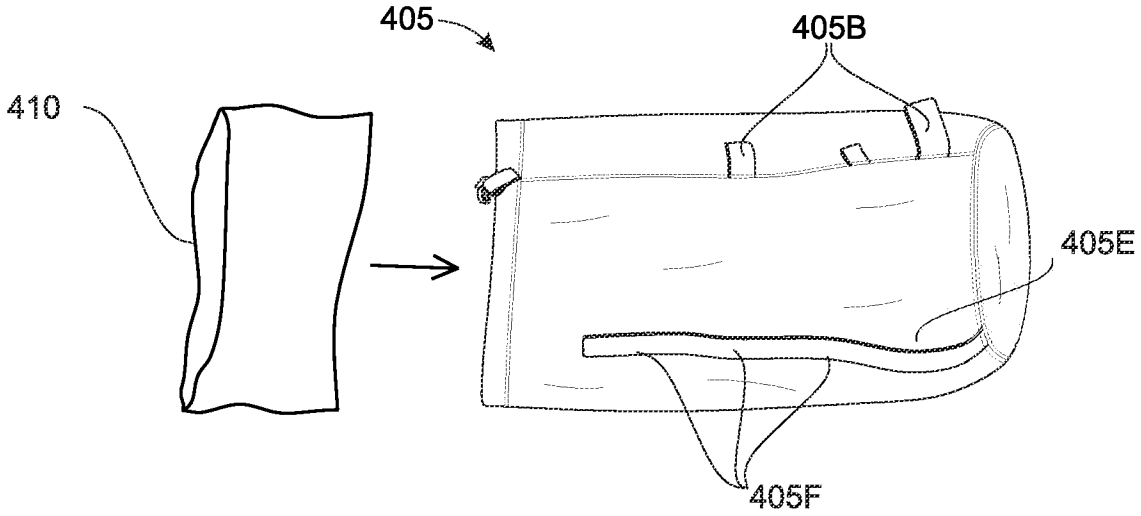
FIG. 4D depicts an illustrative bag extension.
Figure 8A:
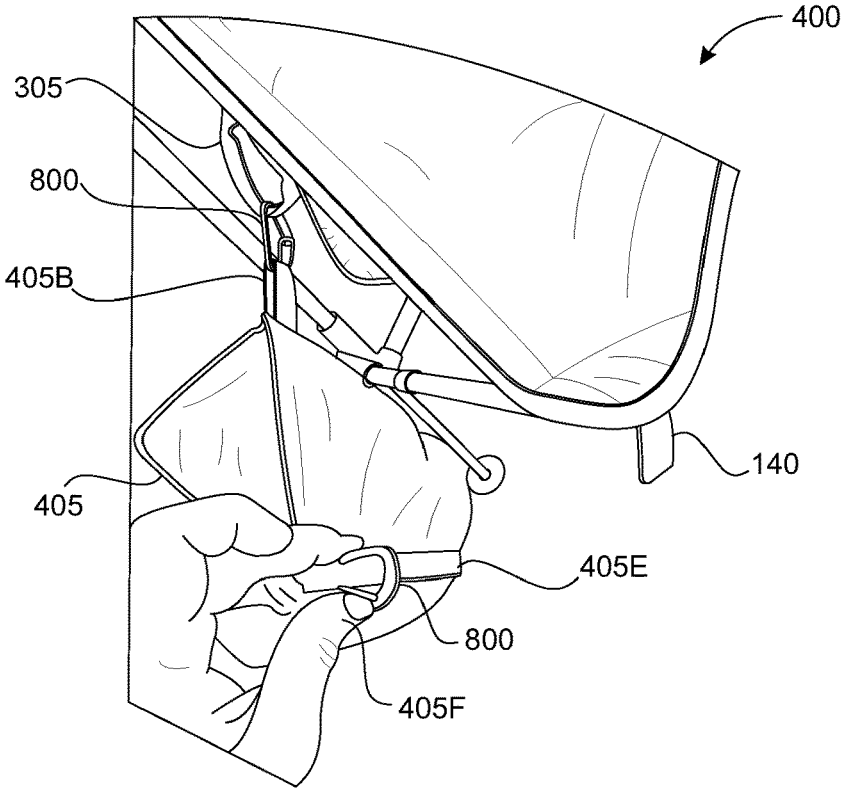
FIG. 8A, 8B depicts side perspective views of an exemplary stowage bag configured to attach to a collapsible chair.
Figure 8B:
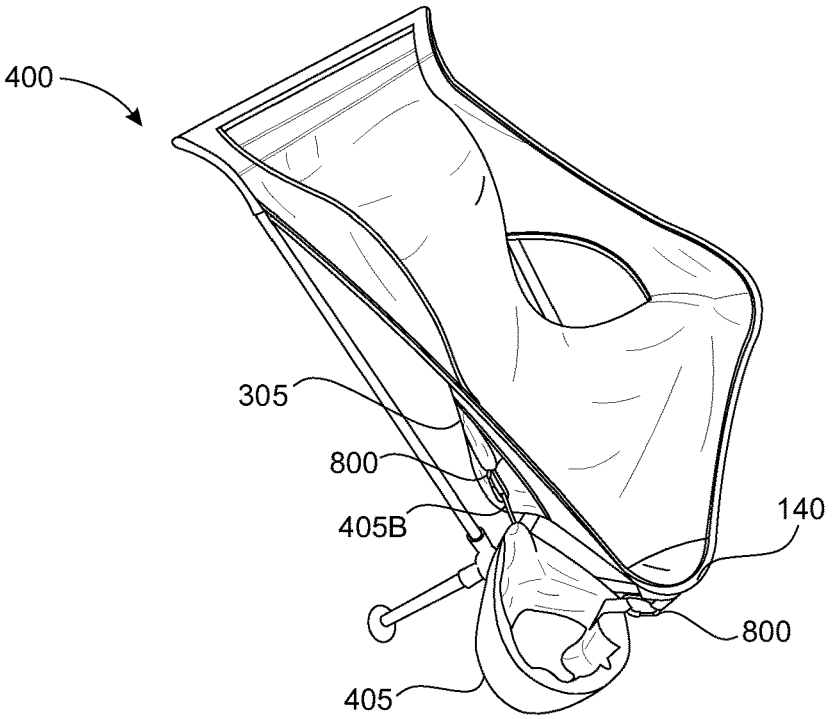

FIGS. 4A, 4B, and 4C depict side and top perspective views of an exemplary stowage bag for a collapsible chair, including an exemplary thermal insulation core/insert. An exemplary collapsible carry/stowage bag 405 may be configured to attach to a collapsible chair (e.g., as shown in FIGS. 8A and 8B and described below). The collapsible bag 405 may extend longitudinally and define a hollow opening 405A. The collapsible bag 405 may be deformable, such that the bag is configured to fold/roll back onto itself (see, e.g., FIG. 4C). The bag may include loops 405B configured to attach to (forward) loops, lateral arm loops, frame pole or leg on a collapsible seat/chair (e.g., via clips/latches/carabiners). A (neoprene) insert 400 may have multipurpose use for: (1) keeping the bag 405 upright and to provide support, (2) acting as a thermal insulator, and/or (3) functioning as protection from sharp objects placed in the lightweight bag to prevent punctures, cuts, or abrasions. The insert 400 may be formed of a generally flexible/deformable and thermally insulative material (e.g., about (0.35) Metric RSI (K·m2/W), or (2) US R-Value). In some examples, the insert 400 may be at least partially formed of a waterproof material, such the insert 400 may act as a bucket or vessel for water or other fluid. In various implementations, the bag 405 may be waterproof/water resistant (e.g., with a fabric, waterproof backing and double stitch construction). The insert 400 may also made of waterproof/water resistant material. Furthermore, the insert 400 may also have the shape of a bag or a bucket.

In an exemplary process of combining use of the bag 405 with the insert 400, a user may first collect or provide the bag and insert together (as shown in FIG. 4A). Next, the user may place the insert 400 into the bag 405, such that the insert 400 occupies an interior space 405A defined by the bag 405 (as shown in FIG. 4B). The insert 400 itself also includes an interior space 400A, such that items stored within the space 400A may also occupy the space 405A. Next, a top portion 405C of the bag 405 may be wrapped or formed around the inside of the insert 400, as shown in FIG. 4C. Furthermore, the bag 405 may include at least one loop 405B fixed on the outside of the bag 405 that allows the bag 405 to be attached to other objects (e.g., such as collapsible chairs disclosed herein). When the bag 405 and insert 400 are assembled (as shown in FIG. 4C), the top of the bag 405C may extend to the bottom surface of the insert 400A and within the opening/interior 400A. Furthermore, when in the configuration of FIG. 4C, a first loop 405B may be located at a top portion of the wrapped-down bag 405, with a second loop 405B located at a bottom portion of the wrapped-down bag 405. The bag 405 may also include a drawstring 405D configured to cinch and close the top opening of the bag 405. The bag 405 may further include at least one longitudinally extending strip 405E fixed to the bag that forms multiple apertures 405F spatially distributed along the length of each of the longitudinally extending strips 405E, each aperture 405F being configured to receive a carabiner or other fastener to couple the bag to an object such as a chair.

The bag 405 and thermal insert 400 system may be used for storing a cold drink for a user. For example, and as shown in FIG. 8B, the bag 405 and insert 400 combination may be attached to a collapsible chair 400 to be beneficially used as a thermally insulated cup holder. In some examples, the bag 405 fitted with the thermal insert 400 may be used to store other hot or cold items, to provide insulation and decreased thermal dissipation for objects/fluids residing inside of the bag and thermal insert system.

Figure 5A:
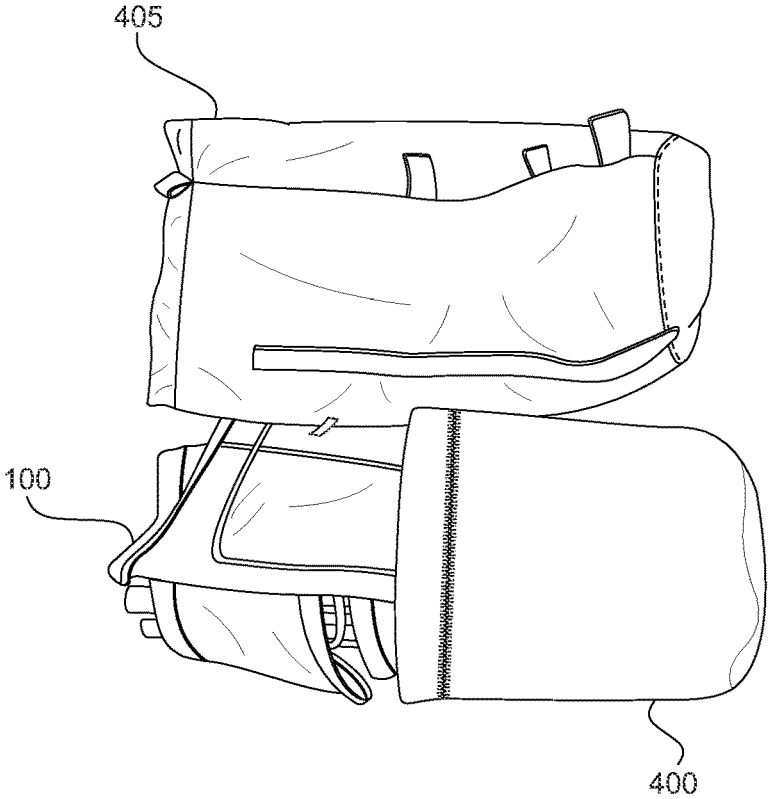
FIGS. 5A, 5B, and 5C depicts side views of an exemplary stowage bag configured to store an exemplary collapsible chair nested inside of an exemplary thermal insulation core/insert.
Figure 5B:
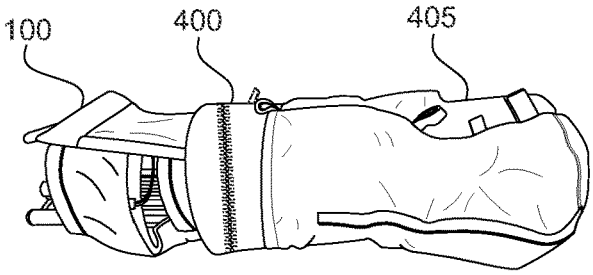
Figure 5C:
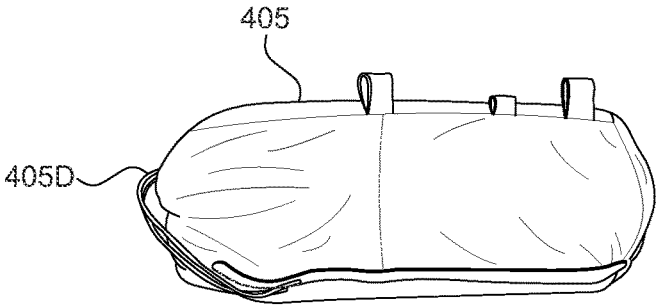

FIGS. 5A, 5B, and 5C depict side views of an exemplary stowage bag configured to store an exemplary collapsible chair nested inside of an exemplary thermal insulation core/insert. A collapsed chair 100 (or other collapsible chair/seat), when collapsed, may be configured to fit within the bag 405 (including the insert 400). The collapsed chair 100 may be collapsed, placed in the insert 400 (see FIG. 5A), and then both may be inserted into the bag 405 (see FIG. 5B), at which point the drawstring 405D of the bag 405 is cinched to close the bag 405 for stowage and transport (see FIG. 5C). A bag extension 410 may be used, in some embodiments, to extend the length of the bag. An add-on extension to the bag may enable the bag to fold into itself for both compact or extended stowage options.

Figure 6B:
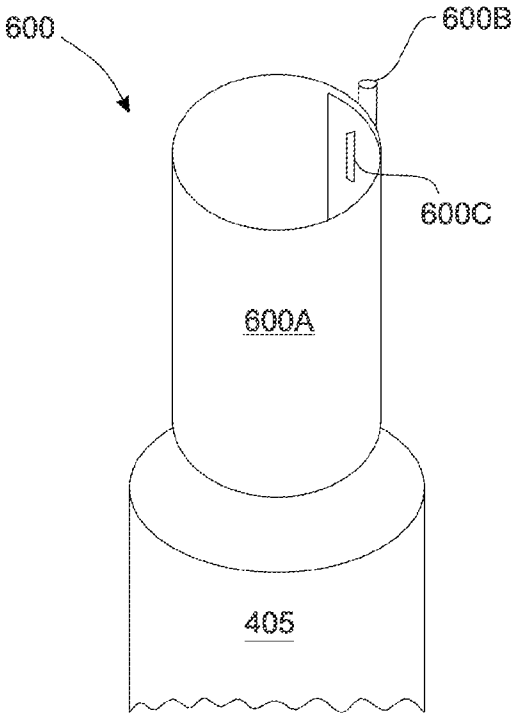
FIGS. 6A and 6B depict perspective views of an exemplary inflatable core/insert for use with an exemplary stowage bag.
Figure 6A:
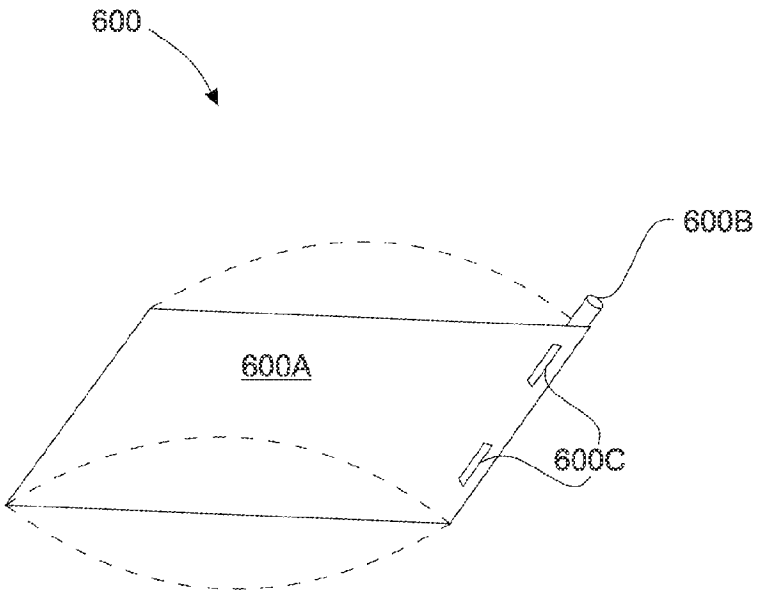

FIGS. 6A and 6B depict perspective views of an exemplary inflatable core/insert for use with an exemplary stowage bag. A user may find significant rugged utility from the bag 405 and thermal insert 400 combination. However, other core/inserts may also be used in conjunction with the bag 405 for even more functionality and application. For example, and as seen in FIG. 6A, an inflatable core/insert 600 may include an inflatable bladder section 600A that may have a substantially flat profile when in a deflated state. The inflatable bladder section 600A is configured to inflate via an inlet/outlet valve 600B of the inflatable insert 600, where the inlet/outlet 600 permits selective fluid (gaseous) communication between the inflatable interior of the bladder 600A and external ambient fluid medium (e.g., air). The inflatable insert 600 also includes at least one fastener (e.g., hook and loop) configured to fasten the bag to an object.

For example, and as shown in FIG. 6B, the (hook and loop) fasteners 600C may be used to configure the inflatable insert into a cylindrical shape, suitable for insertion into the flexible bag 405. In another example, the (hook and loop) fasteners 600C may be used to fasten the insert 600 to an (interior) surface of the bladder section 600A. Once inserted into the bag 405, the insert 600 may be inflated by a user to expand the insert 600 inside of the bag. Once the insert 600 is fully expanded, the (inflated) core 600 within the flexible bag 405 may beneficially act as a pillow or cushion for sleeping or relaxation, in various applications.

Figure 7B:
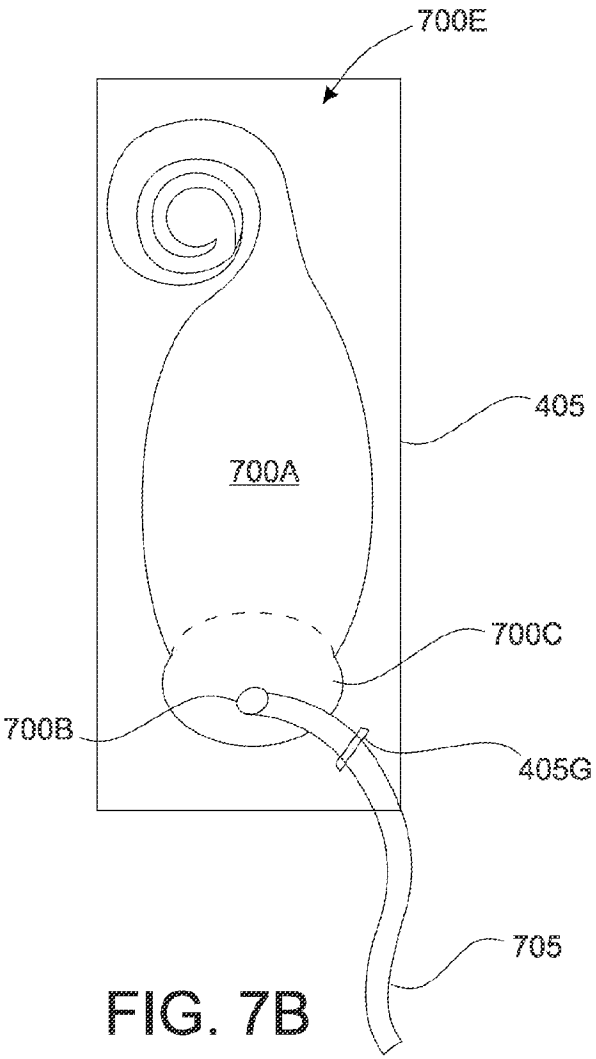
FIG. 7B depicts a side cross-sectional view of an exemplary fluid filter core/insert operably residing within an exemplary stowage bag.
Figure 7A:
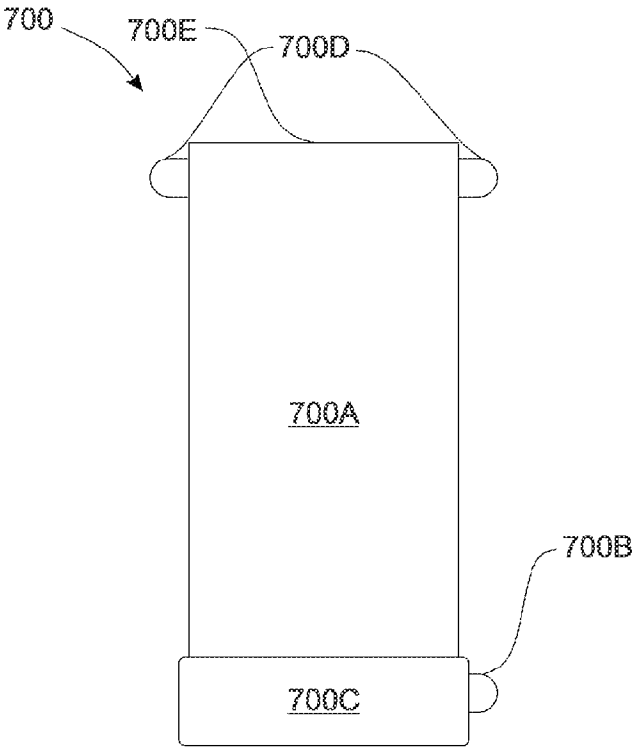

FIG. 7A depicts a top plan view of an exemplary fluid filter core/insert for use with an exemplary stowage bag, while FIG. 7B depicts a side cross-sectional view of an exemplary fluid filter core/insert operably residing within an exemplary stowage bag. Yet another core/insert that may also be used in conjunction with the bag 405 is an exemplary fluid (water) filtering core/insert 700. The water filter insert includes a fluid bladder or reservoir section 700A. The fluid bladder section 700A may store water that exits through an outlet or nozzle 700B after being filtered through an integrated (water) filter 700C. The water filter core 700 further includes at least one fastener 700D (e.g., clasps) configured to fasten the core 700 to another object (e.g., fasten to a tree, the bag 405, or the core 700 itself). The water filter core 700 further includes an inlet (e.g., valve or open end) 700E configured to receive the water/fluid into the reservoir 700A. The water filter core 700 may beneficially utilize the force of gravity to filter water while going on day- or week-long expeditions, where filtering water to make it safe for human consumption may be an absolute necessity.

As shown in FIG. 7B, the water filter core 700 is configured to be stored within the interior of the flexible bag 405. The flexible bag 405, in this exemplary depiction, includes a reinforced aperture 405G, which may be a rigid grommet 405G or a durable slit 405G through which a tube or line 705 (that connects at the filter outlet 700B) may be inserted. In illustrative operational use, a user may collect water from a stream, pond, or other body of water into the reservoir 700A (via the inlet 700E). Once the user goes back to camp, the user may hang the water filter core 700 (along with the flexible bag 405) on a tree or other nearby structure. Once hanging, the user may then open the outlet nozzle 700B, which results in filtered water (sourced from the reservoir 700A) being egressed out the nozzle 700B (after being filtered through the water filter 700C). If the nozzle 700B is connected to the outlet tube 405G, then filtered water will flow out of the nozzle 700B, through the tube 405G, and then to another external destination (e.g., into the user's cup, or a larger external potable water store).

In some examples, the nozzle may be a selectively adjustable nozzle configured to selectively permit or prevent water from the reservoir exiting out of the nozzle (e.g., the nozzle may be an adjustable valve with on/off settings, or a continuous adjustment for various flow rates out of the nozzle). In some implementations, the water filter core may be referred to as a gravity bag filter (device), while the water filter core and bag 405 combination may be referred to as a gravity filter system. Various examples may include a reinforced area (e.g., slit or aperture) on the carry bag 405 to allow gravity bag filter tube 705 to exit bottom of the bag 405.

Various implementations may advantageously include the carry bag 405 adaptable for multiple uses with an array of different inserts/cores. For example, the carry bag 405 is adaptable to convert from a lone carry bag 405, into a cup holder system (see, e.g., FIG. 8B). The carry bag 405 may include various removable inserts 600, 700 that transform the bag 405 into yet other functional devices (e.g., a pillow with the inflatable insert 600, or a gravity bag water filter with the filtering insert 700). The carry bag 405 may further include an extension for several positions (e.g., for if a user does not desire to collapse the laterals fully). An extension add-on to the existing compact carry bag may allow the user to stow the chair in, for example, a rolled format, or collapsed along a longitudinal axis.

FIG. 8A, 8B depicts side perspective views of an exemplary stowage bag configured to attach to a collapsible chair. As seen in FIG. 8A, the bag 405 is being attached to the gear loops 140 of an exemplary collapsible chair 400, which is depicted in this example as similar to the chair 300 described with reference to FIG. 3. A user may secure a first loop 405B of the bag 405 to an arm loop 305 of the chair 400 (e.g., via a fastener such as a latch hook or carabiner 800). Next, the user may secure an aperture 405F of the strip 405E to a (front) loop 140 of the chair 400 (e.g., via a fastener such as a latch hook or carabiner 800). As shown in FIG. 8B, once attached, the bag 405 and insert 400 system may hang from a (front) lateral/side area of the chair 400.

FIGS. 9A-9F depicts an exemplary process for applying an exemplary open slot shock cord keeper to an exemplary collapsible chair frame. The shock cord keeper 900 may be sized to fit within a distal opening of a support/leg/member of a collapsible chair (see FIG. 9E). When the shock cord is operably coupled at the mechanical junction of the chair, it may be configured to stretch along a vertically oriented axis, yet be limited in stretchable length by the keeper that may be in forceable/compressive contact with the distal end of the rod.

Figure 9C:
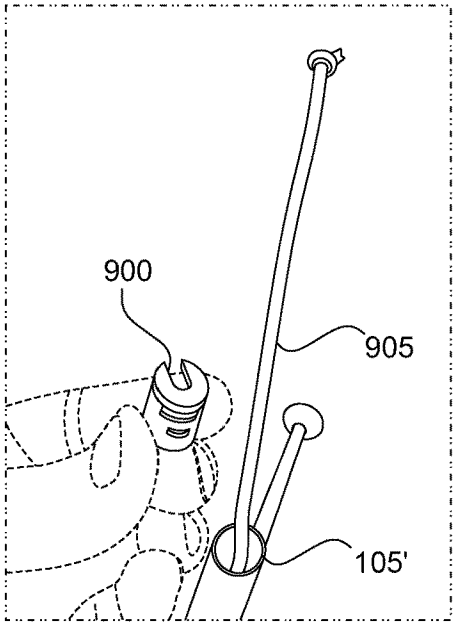
FIGS. 9A-9F depicts an exemplary process for applying an exemplary open slot shock cord keeper to an exemplary collapsible chair frame.
Figure 9B:
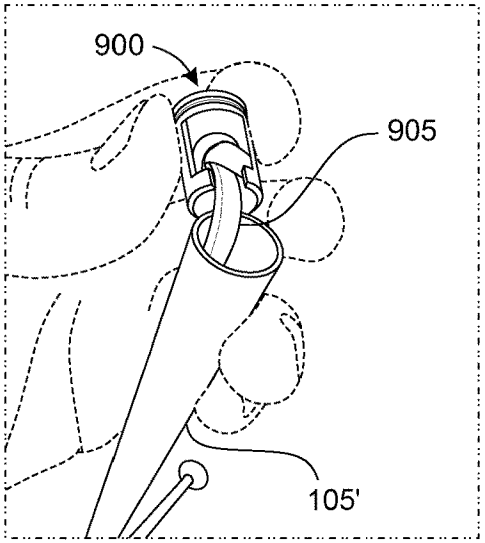
Figure 9A:
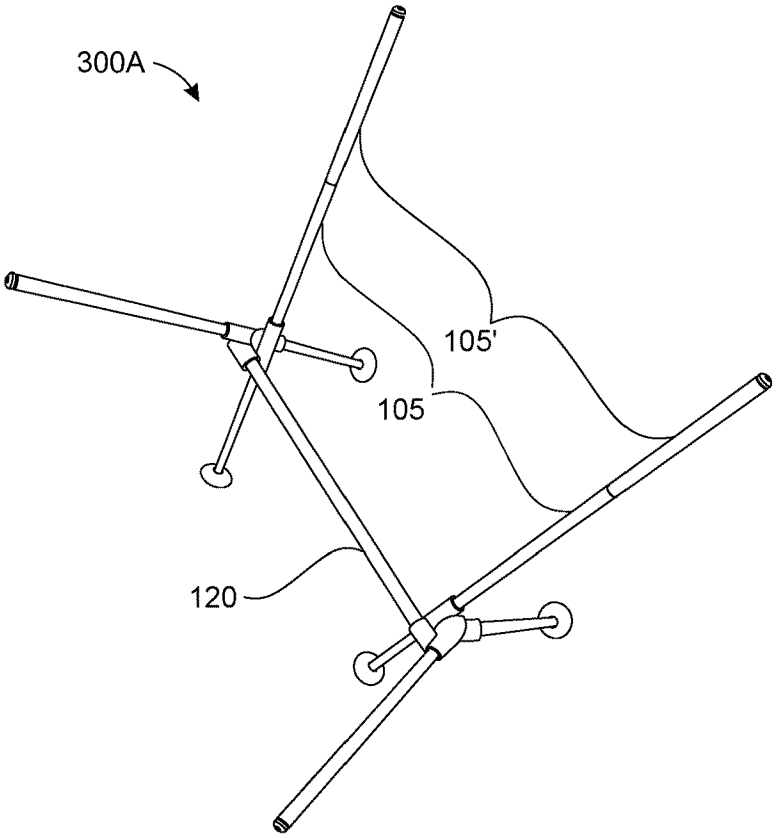
Figure 9F:
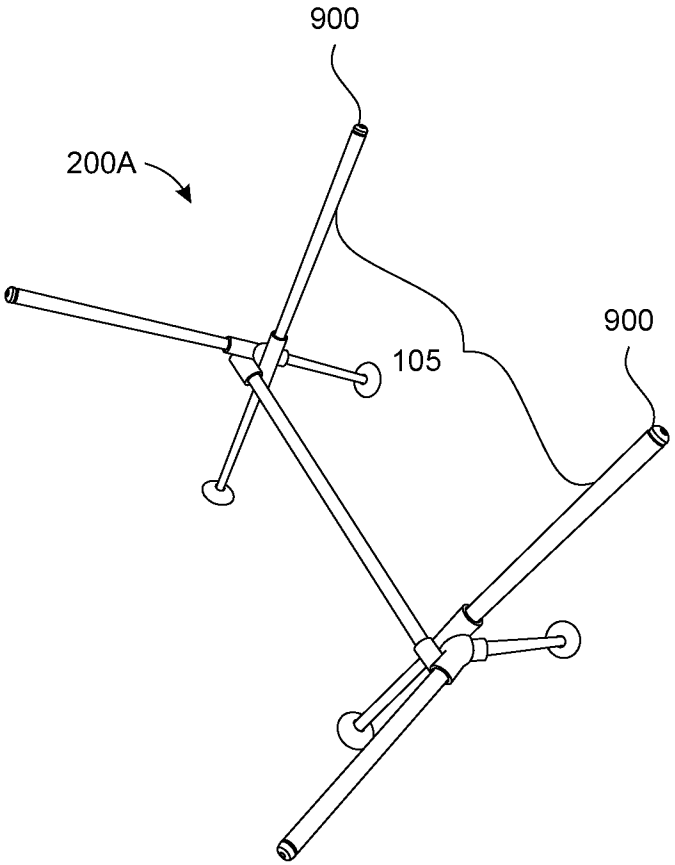
Figure 9E:
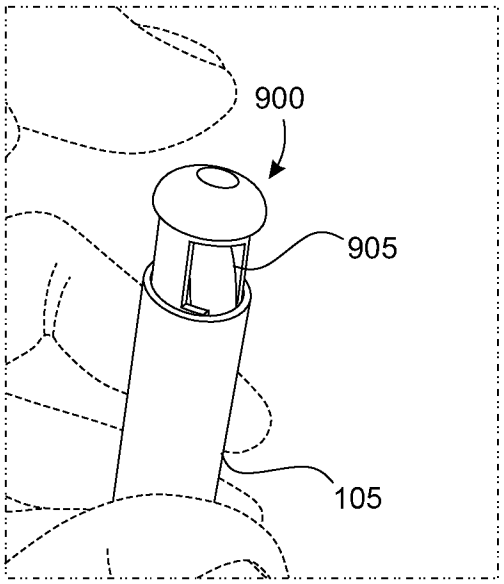
Figure 9D:
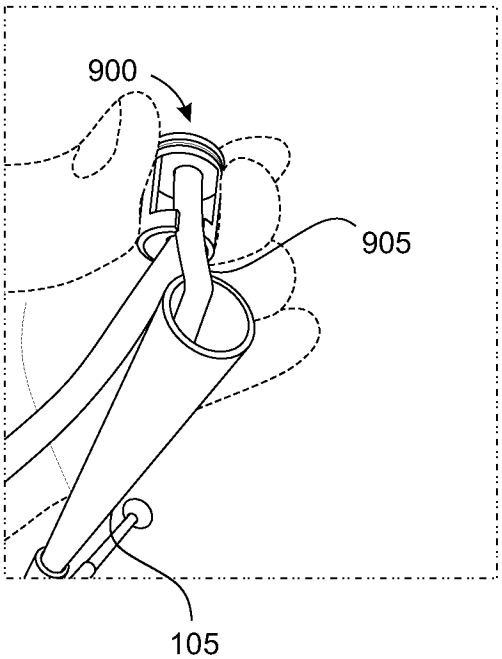

An exemplary method illustrated in the sequence of FIGS. 9A-9F may start at FIG. 9A, with providing a chair frame 300A. Next, in FIG. 9B, the user may assemble a knotted shock cord 905 into the cavity of the keeper 900 and then place the keeper 900 into a hole of the member 105' included with a chair frame 300A. Next, the user may decouple the keeper 900 from the cord 905 (as seen in FIG. 9C), then remove the top halves of each member 105', to transition the vertical profile frame 300A into a recon seat frame 200A having (shorter) members 105. Next, as seen in FIG. 9D, the user couples the keeper 900 to an intermediate knot along a length of the cord 905, to effectively shorten the cord 905 for adapting to the shorter member 105. Next (see FIG. 9E), the user inserts the keeper into the hole of the shorter member 105. Finally, after both keepers 900 have been coupled at distal ends of the members 105, the chair has completed its transition from the vertical profile chair frame 300A to the recon seat frame 200A, as shown in FIG. 9F.

Figure 10B:
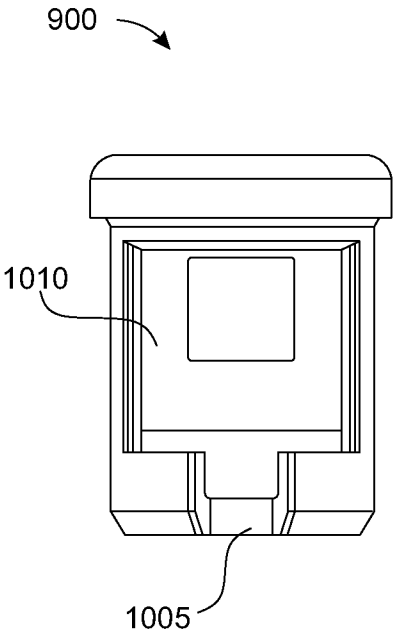
FIGS. 10A and 10B depict bottom perspective and front elevational views, respectively, of an exemplary open slot shock cord keeper.
Figure 10A:
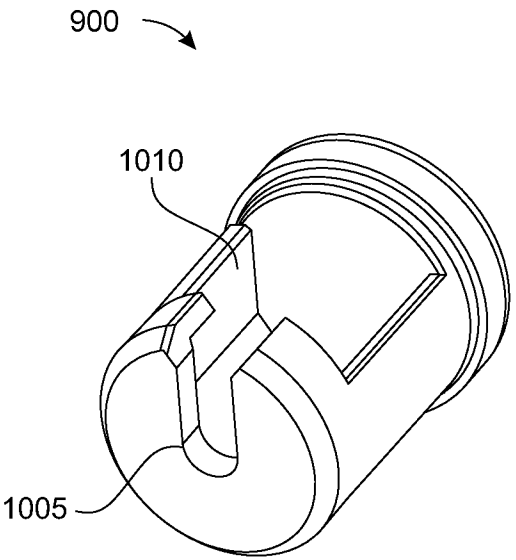

FIGS. 10A and 10B depict bottom perspective and front elevational views, respectively, of an exemplary open slot shock cord keeper. An open slot shock cord keeper 900 includes a (radial) slot 1005 at a proximal end configured to receive an end of a shock cord. The slot 1005 continues into a hollow central opening or cavity 1010 that has a larger lateral length than the lateral length of the slot, such that the distal end of a shock cord (which may be tied off, see FIG. 9B) can be retaining held in the hollow opening 1010 behind the slot 1005. The keeper 900 may be formed of plastic, metal, or other hard/rigid material. A distal/cap end may have a diameter larger than the diameter of the body of the keeper 900 to allow the keeper 900 to be releasably retained into place (e.g., friction retention fit).

Figure 11A:
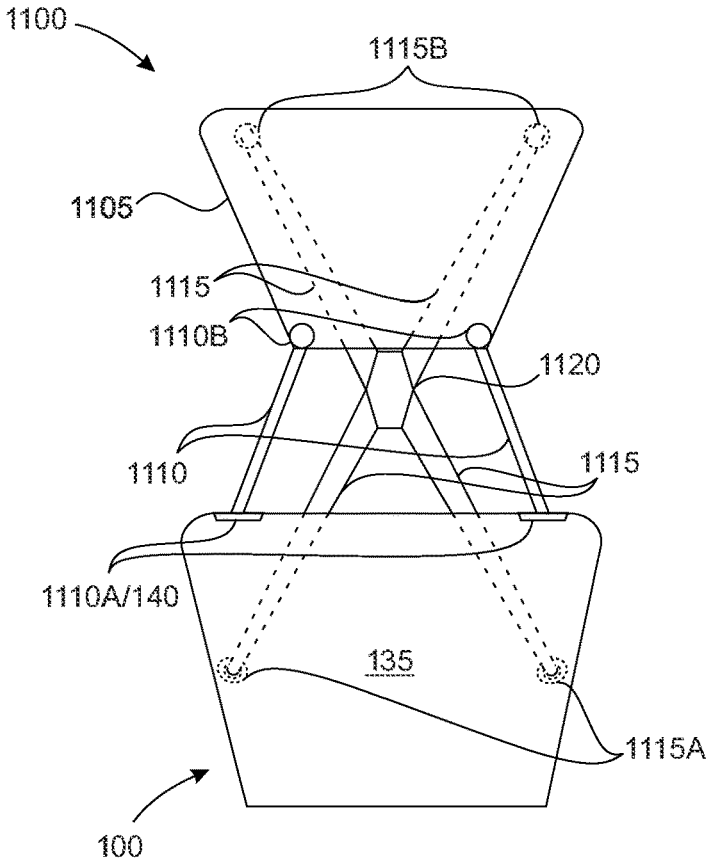
FIGS. 11A and 11B depict top plan and side perspective views, respectively, of an exemplary footrest accessory configured to releasably attach to an exemplary collapsible chair.
Figure 11B:
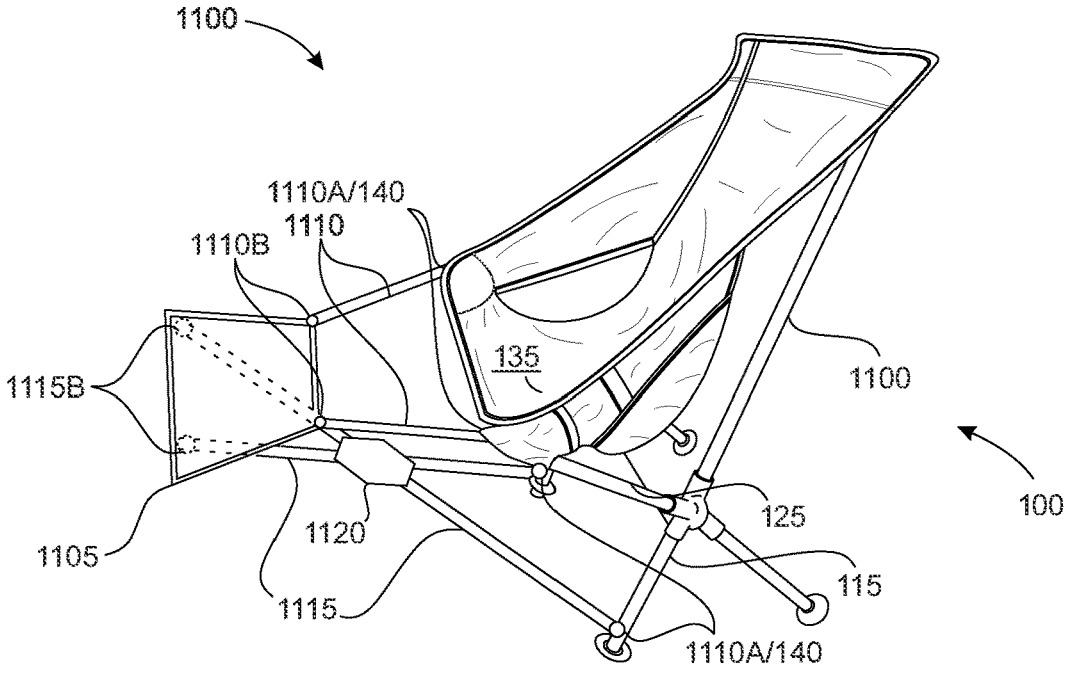

FIGS. 11A and 11B depict top plan and side perspective views, respectively, of an exemplary footrest accessory configured to releasably attach to an exemplary collapsible chair. An exemplary chair and footrest system 1100 includes an exemplary collapsible chair 100 and an exemplary footrest accessory 1105. The footrest 1105 is formed as a trapezoidal shape, in this depiction, which may maximize area useful for foot resting. The footrest may be configured to mechanically couple to a collapsible chair via a pair of footrest support members 1115. The footrest 1105 is shown attaching to forward gear loops 140 on a seat cover 135 periphery of the seat 100. The footrest 1105 may be supported by tube segments or trek pole segments 1115 (in an X shape), and may also fasten (e.g., clip) onto the lower forward legs 115 of the chair frame just above the mushroom seat foot, as seen in FIG. 11B.

More specifically, as shown in FIG. 11A, the footrest 1105 is shown operably coupled to the seat 100 via a pair of first footrest support members 1110 (e.g., rods or straps). Each first footrest support member 1110 is fixedly, yet releasably coupled at a back end to a forward seat coupling point 1110A (at the front gear loops 140) near the front of the seat 100. Each first footrest support member 1110 is fixedly, yet releasably coupled at a front end to back footrest coupling points 1110B at a back section of the footrest 1105.

The footrest 1105 is further operably coupled to the seat 100 (and seat cover 135) via a pair of second footrest support members 1115 that cross one another to form an X shape. Each second footrest support member 1115 is fixedly, yet releasably coupled at a back end to a leg coupling point 1115A at a front leg 115 of the chair 100 (frame). Each second footrest support member 1115 is fixedly, yet releasably coupled at a front end to forward footrest coupling points 1115B at a front section of the footrest 1105. A cross coupler 1120 may also be (optionally) included to mechanically and rigidly couple each of the support members 1115 at the crossing point for increased support and reliability.

Each of the coupling points 1110A, 1110B, 1115A, 1115B may include a fastener or other form of releasable mechanical coupler. For example, the coupling points 1110A may be latching hooks that fasten to the gear loops 140, the coupling points 1110B may be hook and ring fasteners, the coupling points 1110A may be clamp locks, and the coupling points 1115B may be rigid bosses configured to fasteningly receive a front end of one of the second footrest support members 1115. Addition of a low-profile footrest 1105 to a collapsible chair 100 may further increase the utility and comfort of the chair 100.

Figure 12C:
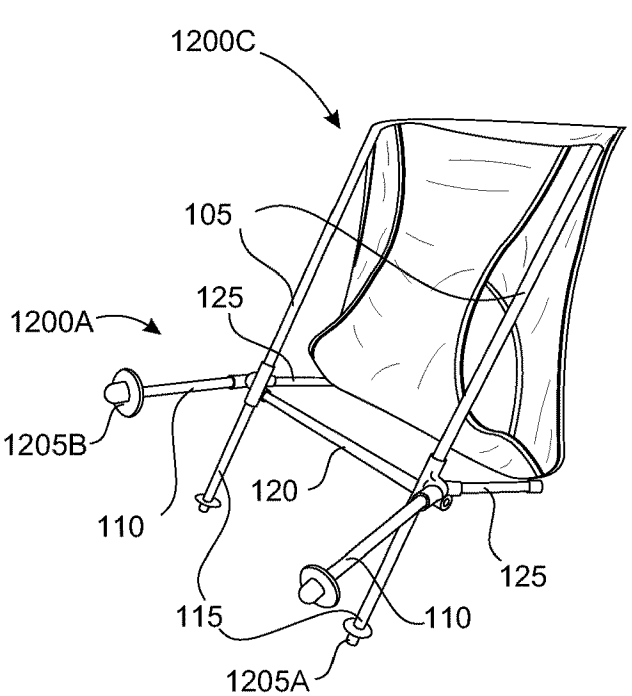
FIGS. 12A, 12B, 12C, 12D, 12E, and 12F depict perspective views of an exemplary process for transitioning an invertible and collapsible chair from a first (vertical/upright) mode to a second (longitudinal/lounge) mode.
Figure 12B:
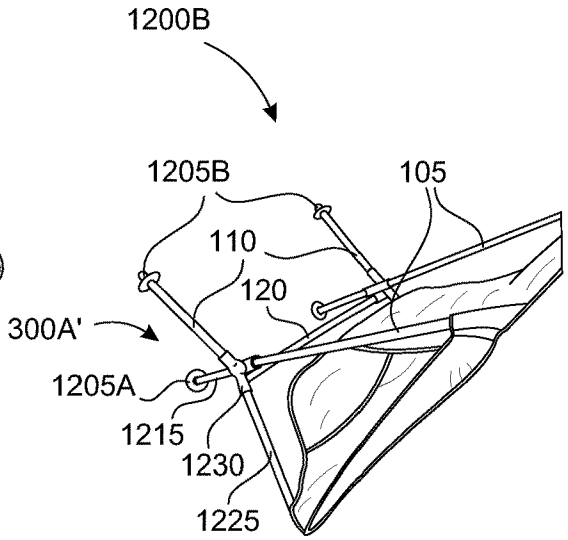
Figure 12A:
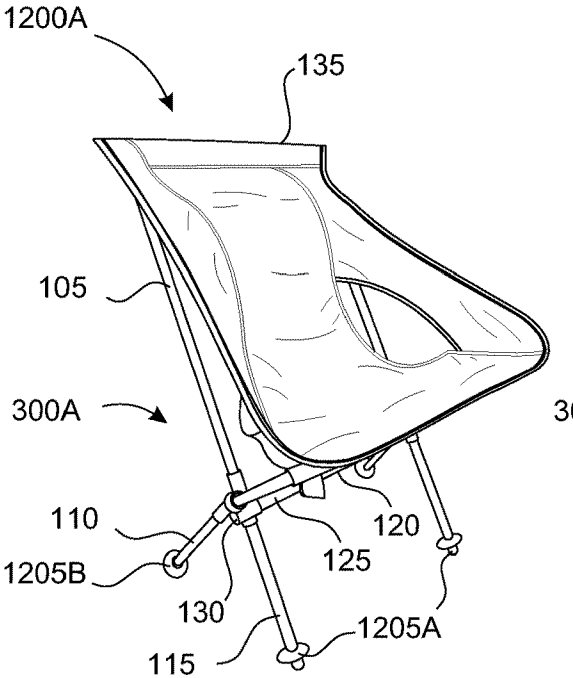
Figure 12D:
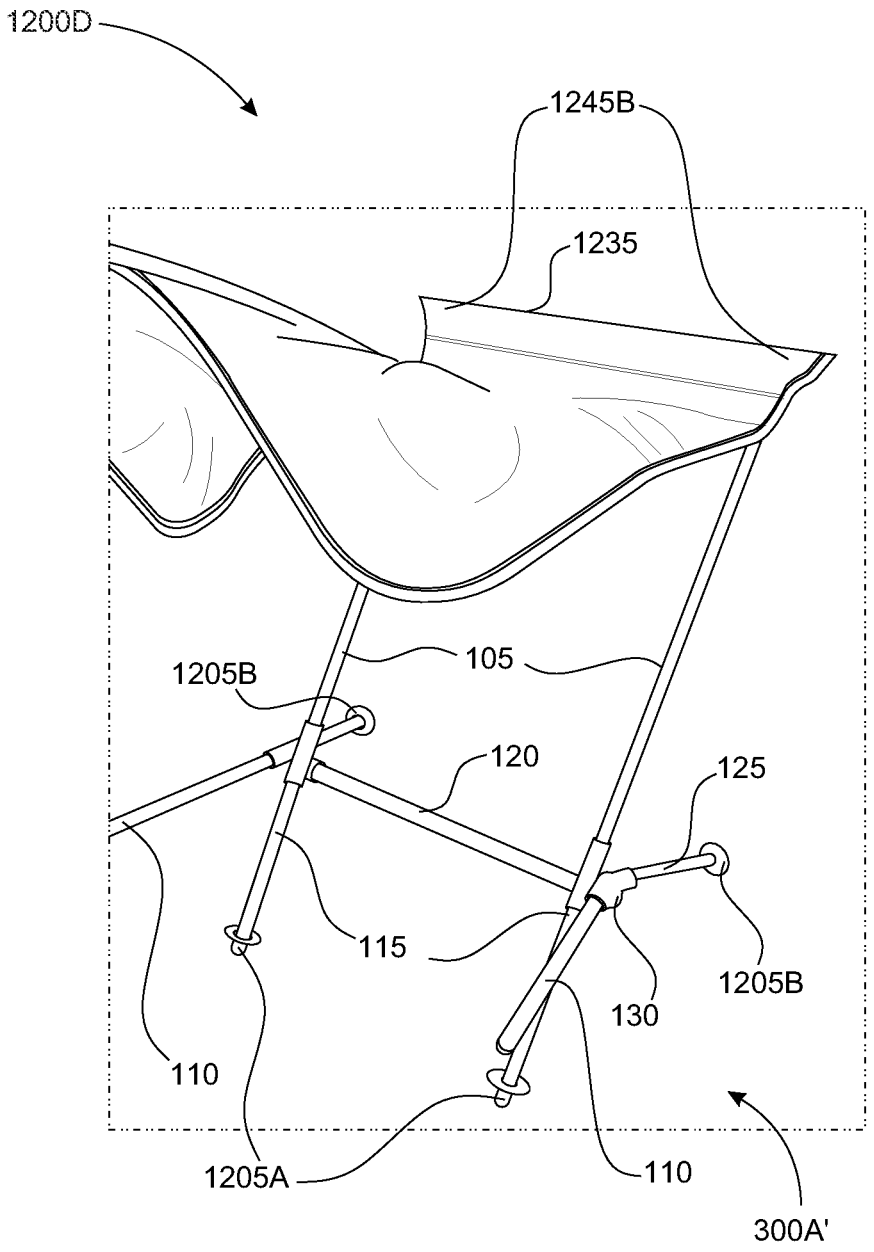

FIGS. 12A, 12B, 12C, 12D, 12E, and 12F depict perspective views of an exemplary process for transitioning an invertible and collapsible chair from a first (vertical/upright) mode to a second (longitudinal/lounge) mode. As shown in FIG. 12A, an invertible and collapsible chair is oriented in a non-inverted (or vertically upright) state 1200A, and includes a chair frame 200A fitted with a (first-sized) vertical-profile flexible chair seat cover 135. The invertible and collapsible chair may utilize the CAPRA™ frame, examples of which are described in U.S. application Ser. No. 15/888,994, the entire contents of which is incorporated by reference herein. In various examples, embodiments of a collapsible chair (e.g., the legs 110, 115, support members 105, 125, and collapsible lateral rod 120) may advantageously construct a beach-style chair with a lowered seat, wider fore/aft stance, and relaxed back. As shown in FIG. 12B, the original CAPRA™ frame 200A is rotated 90 degrees (to an inverted state 1200B) about a lateral axis (to a 90-degree inverted state 200A'), such that the front seat support frame members 125 act as (inverted) rear seat frame legs 125. The back feet 1205B of the chair are then moved (at step 1200C in FIG. 12C) from the back legs 110 to the front seat support frame members 125 (acting as rear seat frame legs 125 in the inverted states 1200B and 1200C). Next (or even before the chair is inverted), the vertical-profile flexible chair seat cover 135 is stripped off of the frame 200A, to make room for a second-sized chair seat cover with a lowered seat, wider fore/aft stance, and relaxed/lounging seat back.

Figure 12E:
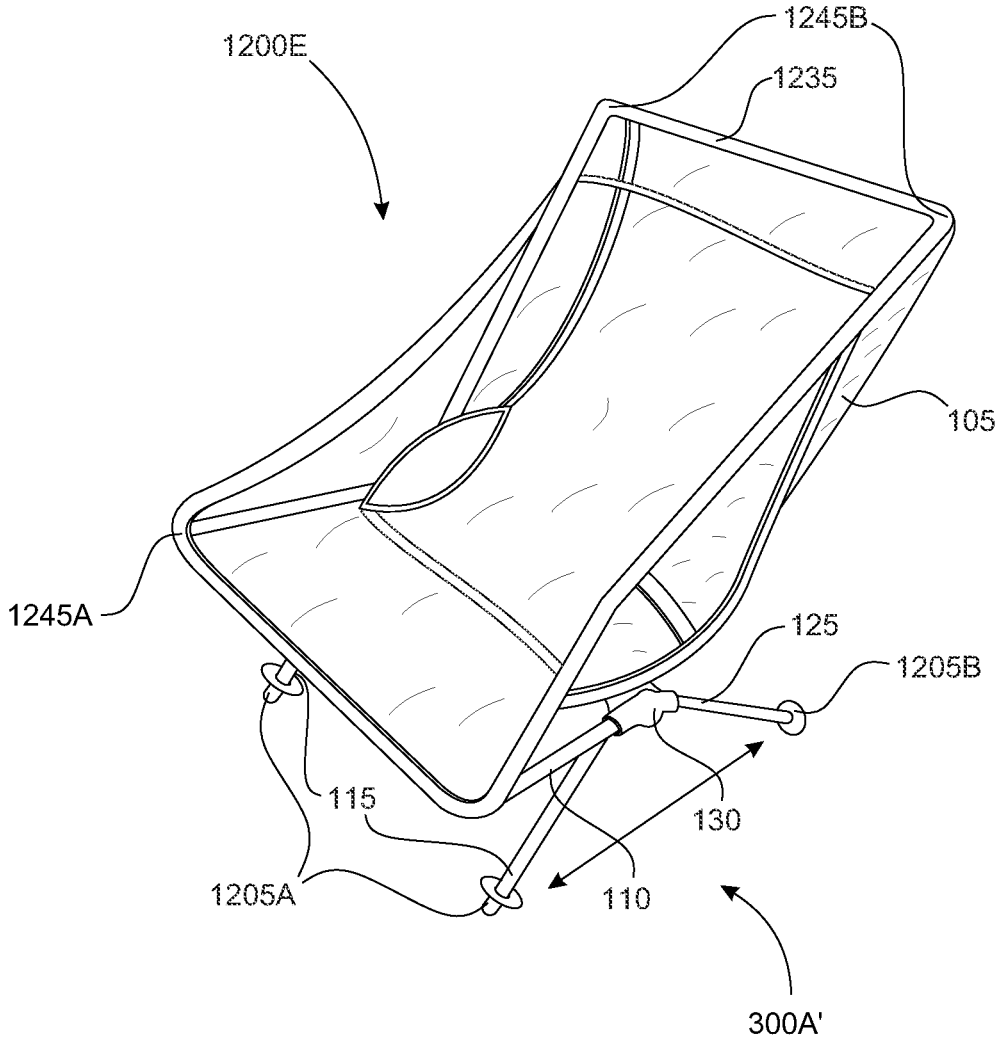
Figure 12F:
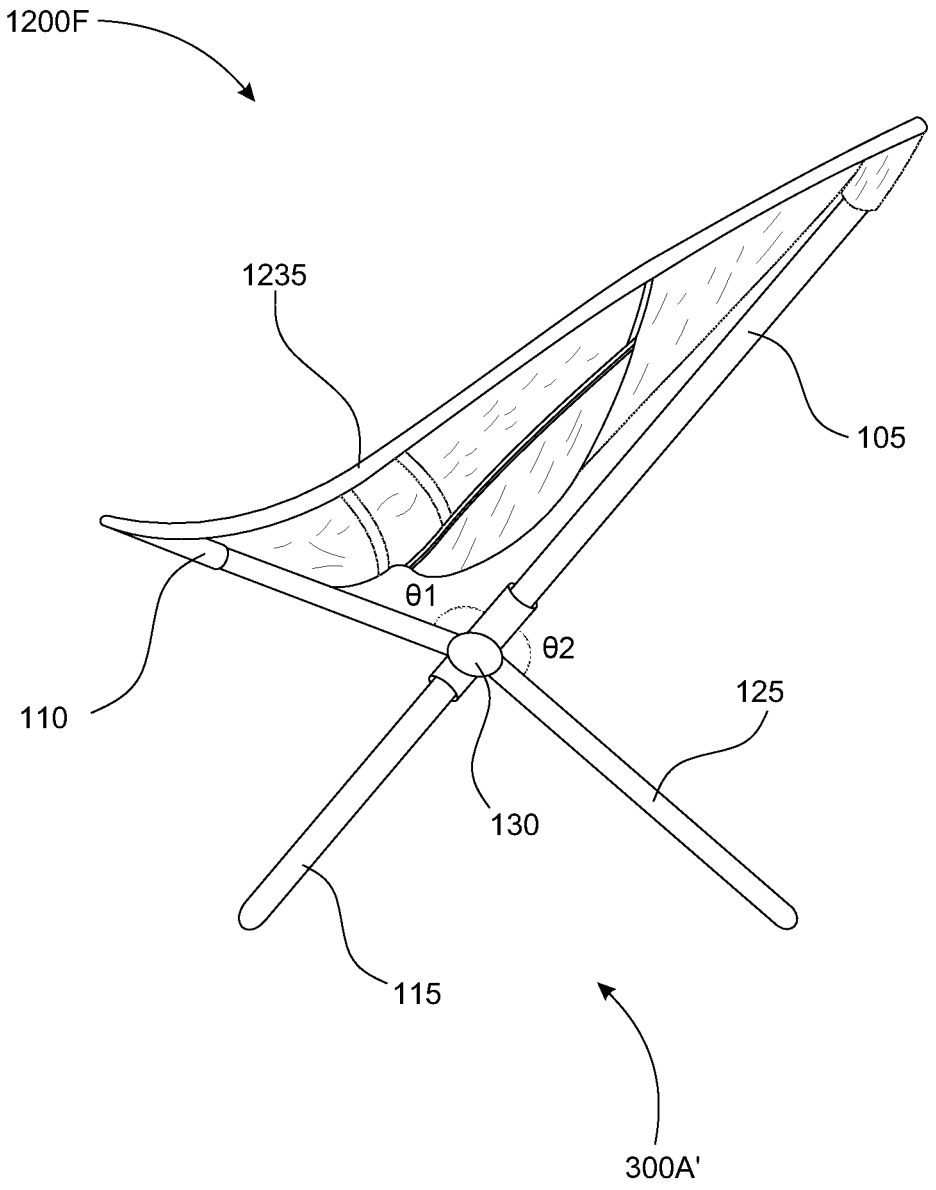

At step 1200D (FIG. 12D), the inverted frame 200A' is outfitted at a top area with a (second-sized) horizontal-profile chair seat cover 1235. More specifically, top pockets 1245B of the horizontal-profile chair seat 1235 are fitted onto the distal ends of the support members 105, respectively. Finally, the front section of the second-sized chair seat cover 1235 is coupled to the front section of the inverted chair frame 200A'. More specifically, front pockets 1245A of the horizontal-profile chair seat 1235 are fitted onto the distal ends of the support members 110, respectively, to transition the collapsible seat from a non-inverted (or vertically upright) state 1200A (FIG. 12A) to an inverted (or horizontally profiled) state 1200E (FIG. 12E). FIG. 12F depicts a side view of the inverted (or horizontally profiled) state 1200E, illustrating a first angle θ1 between the rods/members 105 and 110, as well as a second angle θ2 between the rods/members 105 and 125. In an illustrative embodiment, the first angle θ1 defined by a front chair support and associated back chair support is less than or equal to 90 degrees, while the second angle θ2 defined by a back leg and a right back chair support is greater than 90 degrees (e.g., as shown in FIG. 12F). The invertible collapsible chair (in inverted mode or state 1200E) may therefore be a freestanding high back seat with obtuse angle between upper forward and back legs and lower forward and back legs, to advantageously provide for a more laid back beach/camp chair.

Figure 13A:
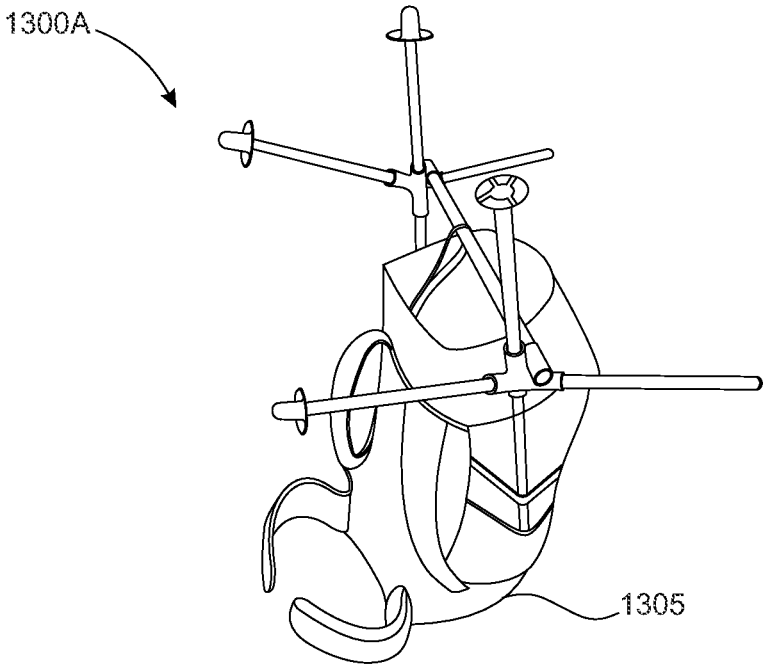
Figure 13B:
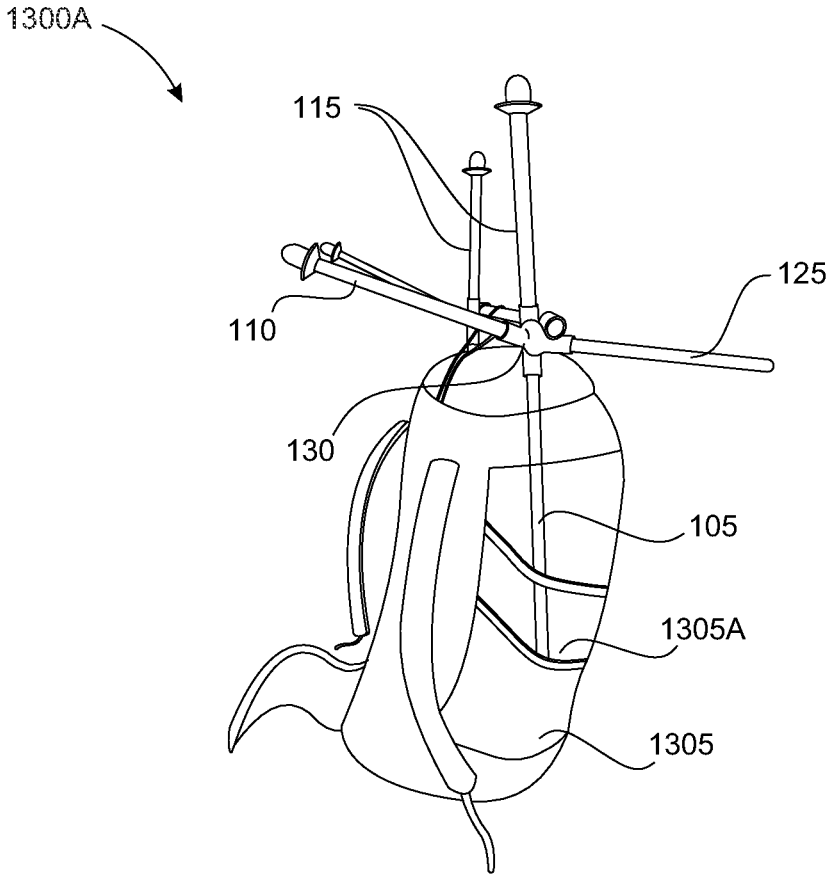
Figure 13C:
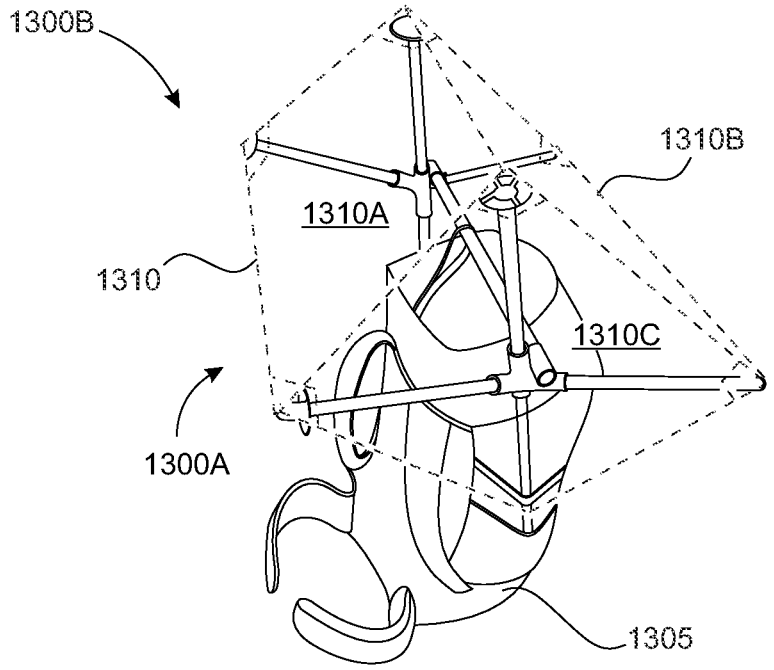
FIGS. 13C and 13D depict side perspective and side elevational views, respectively, of an exemplary collapsible chair frame deployed as a multi-functional sun canopy/rain cover on an exemplary backpack (with cover present).
Figure 13D:
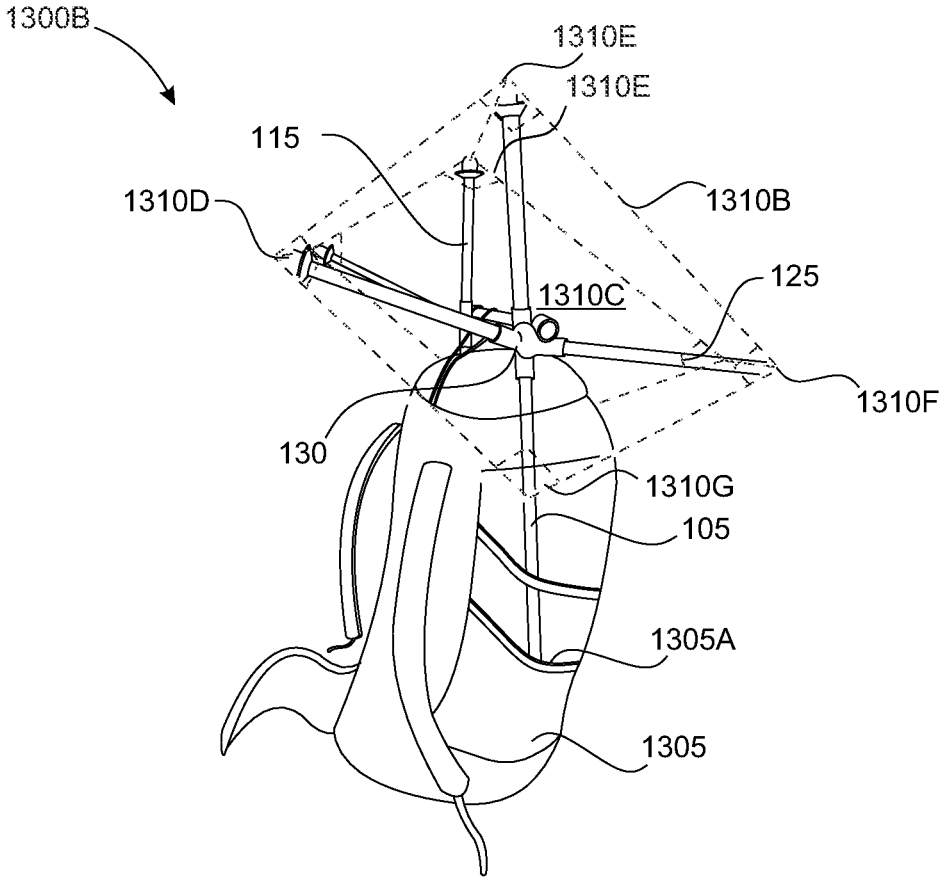

FIGS. 13A and 13B depict side perspective and side elevational views, respectively, of an exemplary collapsible chair frame deployed as a multi-functional sun canopy/rain cover on an exemplary backpack (without the cover), while FIGS. 13C and 13D depict side perspective and side elevational views, respectively, of an exemplary collapsible chair frame deployed as a multi-functional sun canopy/rain cover on an exemplary backpack (with cover present). The original CAPRA™ frame 200A may be converted/transformed into a sun canopy or rain cover 1300A (with cover removed for illustrative purposes), which may be held like an umbrella, or inserted into the outer pockets 1305A of a backpacking pack 1305 (by both longer segments 105 of the frame 200A). In this sense, a multi-functional sun canopy/rain cover may advantageously provide shade for hikers without the burden of carrying an additional umbrella or rain canopy (e.g., a "sunbrella" while on the trail, and a seat that can be used while in camp).

As shown in FIGS. 11A and 11B, the original CAPRA™ frame 200A is inserted into the vertically extending pockets of a backpack. A canopy cover 1310 is then placed on the frame 200A (as shown in FIGS. 11C and 11D), with pockets that receive the rigid support members/legs 105, 110, 115, 125 of the frame 200A. The canopy 1310 includes a pair of laterally opposed surfaces 1310C, a front surface 1310A, and a back surface 1310B. The surfaces 1310A, 1310B, and 1310C may substantially shield a user from sun and/or rain while the canopy is installed on the frame 200A coupled to the backpack 1305. As seen in the FIGs., the canopy cover 1310 may also have multiple pockets 1310D, 1310E, and 1310F that each receive an associated distal end of a member/leg 110, 115, 125 of the frame. For example, each of a pair of front sun cover pockets 1310D may couplingly receive a distal end of an associated rod/member 110, each of a pair of middle sun cover pockets 1310E may couplingly receive a distal end of an associated rod/member 115, and each of a pair of front sun cover pockets 1310F may couplingly receive a distal end of an associated rod/member 125 to operably couple the sun/rain cover 1310 to the frame 200A. The cover 1310 may also include another pair of fasteners 1310G (e.g., loops or cords) at a lower area of the cover 1310, each configured to fasten with an associated rod/member 105, to provide even more secure coupling of the sun/rain cover to the frame 200A. Accordingly, a user may use the frame 200A as a collapsible chair frame when the user is sitting down, and then may advantageously convert the frame 200 to a sun canopy/rain cover system

1300B while the user is walking or hiking outdoors, to keep dry from precipitation and/or prevent the user's skin from being sunburned.

Although various embodiments have been described with reference to the Figures, other embodiments are possible. For example, in some embodiments, such as with reference to FIG. 1B, for example, one or more exemplary spacer sleeves may slip onto the upright segment 105 and serve to axially displace a bottom end of the upper pole segment 142B a predetermined distance from the mechanical junctions 130 when the upper pole segment 142B is removably seated on the upright segment 105.

In an exemplary aspect, an adaptive multi configuration chair may include a collapsible frame having a stowed state and a deployed state. The frame includes, in the deployed state, a lateral rod (120) having a right end and a left end, a right mechanical junction (130) coupled to the right end of the lateral rod (120), a left mechanical junction (130) coupled to the left end of the lateral rod (120), a right front leg (115) coupled to the right mechanical junction (130) at a right front leg proximal end and terminating in a right front leg distal end, a left front leg (115) coupled to the left mechanical junction (130) at a left front leg proximal end and terminating in a left front leg distal end, a right back leg (110) coupled to the right mechanical junction (130) at a right back leg proximal end and terminating in a right back leg distal end, a left back leg (110) coupled to the left mechanical junction (130) at a left back leg proximal end and terminating in a left back distal leg end, a right front chair support (125) coupled to the right mechanical junction (130) at a right front chair support proximal end and terminating in a right front chair support distal end, and a left front chair support (125) coupled to the left mechanical junction (130) at a left front chair support proximal end and terminating in a left front chair support distal end. The frame further includes a right back chair support (105) coupled to the right mechanical junction (130) at a right back chair support proximal end and terminating in a right back chair support distal end, wherein, in a first mode (FIG. 2B), a first distance between the right chair support proximal end and the right chair support distal end is greater than a second distance between the right front leg proximal end and the right front leg distal end; and, a left back chair support (105) coupled to the left mechanical junction (130) at a left back chair support proximal end and terminating in a left back chair support distal end, wherein, in the first mode, a third distance between the left chair support proximal end and the left chair support distal end is greater than a fourth distance between the left front leg proximal end and the left front leg distal end. The frame may, in an exemplary embodiment, be reconfigurable between the first mode and a second mode. In the second mode (FIG. 1C), a fifth distance between the right chair support proximal end and the right chair support distal end is greater than the first distance, and a sixth distance between the left chair support proximal end and the left chair support distal end is greater than the third distance such that, in the first mode, the adaptive multi configuration chair is adapted to support a first flexible chair seat and, in the second mode, the adaptive multi configuration chair is adapted to support a second flexible chair seat that is larger than the first flexible chair seat.

In various embodiments, the first flexible chair seat may further include a first front right section, a first front left section, a first top right section, and a first left section, wherein the first-sized flexible chair seat is sized such that, in the first mode, the first front right section is adapted to releasably couple at the right front chair support distal end, the first front left section is adapted to releasably couple at the left front chair support distal end, the first top right section is adapted to releasably couple at the right back chair support distal end, and the first top right section is adapted to releasably couple at the left back chair support distal end. The second flexible chair seat further may include a second front right section, a second front left section, a second top right section, and a second left section, wherein the second-sized flexible chair seat is sized such that, in the second mode, the second front right section is adapted to releasably couple at the right back leg distal end, the second front left section is adapted to releasably couple at the left back leg distal end, the second top right section is adapted to releasably couple at the right back chair support distal end, and the second top left section is adapted to releasably couple at the left back chair support distal end.

The adaptive multi configuration chair may further include a right front foot, a left front foot, a right back foot, and a left back foot. In a first orientation of the adaptive multi configuration chair, the right front foot may be releasably coupled at the right front leg distal end, the left front foot may be releasably coupled at the left front leg distal end, the right back foot may be releasably coupled at the right back leg distal end, and, the left back foot may be releasably coupled at the left back leg distal end. In a second orientation of the adaptive multi configuration chair, the right front foot may be releasably coupled at the right front leg distal end, the left front foot may be releasably coupled at the left front leg distal end, the right back foot may be releasably coupled at the right front chair support distal end, and, the left back foot may be releasably coupled at the left front chair support distal end. In some embodiments, a longitudinal profile length of the multi configuration chair in the second orientation may be greater than a longitudinal profile length of the adaptive multi configuration chair in the first orientation. When chair is supported with respect to a horizontal surface, a vertical profile length of the multi configuration chair in the second mode may be less than a vertical profile length of the adaptive multi configuration chair in the first mode. A first angle defined by the right front chair support and the right back chair support may be less than or equal to 90 degrees, and a second angle defined by the left front chair support and the left back chair support may be substantially equal to the first angle. A third angle defined by the right back leg and the right back chair support may be greater than 90 degrees, and a fourth angle defined by the left back leg and the left back chair support may be substantially equal to the third angle. The right front leg, right back leg, right front chair support, and right back chair support may be each individually shock-cord-coupled to the right mechanical junction (130). The left front leg, left back leg, left front chair support, and left back chair support may be each individually shock-cord-coupled to the left mechanical junction (130). The lateral rod further may include a collapsible lateral rod having at least a first rod section releasably coupled to a second rod section.

At least one of the first-sized flexible chair seat and the second-sized flexible chair seat may include at least one arm loop (305) disposed at a lateral arm area of the adaptive multi configuration chair and configured to receive a releasably attachable accessory.

The adaptive multi configuration chair may further include an insert (400) formed of a flexible material in the shape of a bag defining, in a carry mode, a cavity sized to receive the frame in a collapsed state, and further defining, in an accessory mode, means for releasably coupling to at least one of the left and right front chair supports. The insert further may include a flexible wall adapted, in the accessory mode, to form a pocket when a first portion of the wall is folded inside a second portion of the wall. The insert may be further adapted, in the accessory mode, to receive and releasably contain an inflatable accessory sized to substantially conform to the formed pocket.

In some examples, the adaptive multi configuration chair further may include a footrest module having at least two laterally spaced attachment members configured to releasably attach to and extend from a front portion of the frame. The footrest module further may include a substrate forming a footrest surface that extends between at least two laterally spaced attachment members that are releasably attached to and extended from a front portion of the frame.

In some examples, the adaptive multi configuration chair further may include a canopy module having a flexible sheet material sized and configured to form a barrier surface when extending among, and releasably supported by, the left and right front legs, the left and right front chair supports, and the left and right back legs, when the frame is in the deployed state. The flexible sheet material may be adapted to attenuate light penetration through the barrier surface.

In another exemplary aspect, an adaptive multi configuration chair may include a collapsible frame having a stowed state and a deployed state, and at least one seat cover configured to couple to the frame to form a seating surface when the frame is in the deployed state. The chair further includes means for containing the frame when the frame is in the stowed state and attaching to the frame when the frame is in the deployed state.

In some embodiments, the chair may further include means for transforming the frame into a canopy defining a barrier surface, and/or means for providing a footrest for use by a user supported on the seating surface.

It may be appreciated that the foregoing features described in various examples may be arranged in combinations that, although not exhaustively described, may be readily apprehended.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An adaptive multi configuration bag comprising:

A collapsible bag having an aperture at one end and extending longitudinally along a longitudinal axis to define a hollow cavity, the collapsible bag being flexible and having an unfolded stowage state and a folded accessory state; and, a plurality of coupling modules secured to an exterior of the collapsible bag, the plurality of coupling modules comprising a strap disposed along an outside of, and parallel to the longitudinal axis of, the collapsible bag, wherein the strap is coupled to the collapsible bag at a plurality of locations along its length to form a plurality of coupling apertures; and, wherein, in the unfolded stowage state:

the collapsible bag is extended longitudinally to receive and substantially enclose a collapsible frame, in a collapsed state, and at least one covering adapted to be fitted thereon;

the collapsible bag is transitioned from the unfolded stowage state to the accessory state by folding the bag down longitudinally inside the hollow cavity, forming a folded edge at a top portion of the collapsible bag, such that at least one of the plurality of coupling apertures formed by the strap is accessible at the folded edge in the accessory state; and in the accessory state:

the collapsible bag is configured to be releasably suspended, by the one of the plurality of coupling apertures and at least one other coupling module of the plurality of coupling modules, from an assembly comprising the collapsible frame and covering, the one of the plurality of coupling apertures and at least one other coupling module of the plurality of coupling modules are configured to be releasably coupled to the assembly at locations configured to maintain tension on the collapsible bag in at least partially opposing radial directions, such that the collapsible bag is positioned to receive an object into the hollow cavity through the aperture.

2. The adaptive multi configuration bag of claim 1, further comprising a thermal insert having a second aperture and extending longitudinally to define a second hollow cavity, wherein:

the thermal insert is configured to be deployed within the hollow cavity of the collapsible bag by being inserted therein through the aperture thereof when the collapsible bag is in an accessory state, the collapsible bag being folded down inside the second hollow cavity of the thermal insert, the thermal insert lines the hollow cavity of the collapsible bag when deployed therein in an accessory state, and the thermal insert is further configured to receive the collapsible frame within the second hollow cavity and to be stowed within the hollow cavity of the collapsible bag when the collapsible bag is in an unfolded stowage state.

3. The adaptive multi configuration bag of claim 1, further comprising a closure at the aperture.

4. The adaptive multi configuration bag of 3 wherein the closure, when the collapsible bag is in the stowage state, is configured to substantially close the aperture over the covering and the collapsible frame, in a collapsed state, when they are received within the hollow cavity.

5. The adaptive multi configuration bag of claim 1, wherein the coupling modules further comprise gear loops.

6. An adaptive multi configuration bag comprising:

a collapsible bag having an aperture at a distal end and extending longitudinally to define a hollow cavity, the collapsible bag being flexible and having a stowage state and an accessory state; and a plurality of coupling modules, disposed on an exterior of the collapsible bag proximal to the distal end;

wherein:

in the stowage state:

the collapsible bag is extended longitudinally to receive and substantially enclose in the hollow cavity a collapsible frame and at least one covering adapted to be fitted thereon, the collapsible frame being in a collapsed state; and in the accessory state:

the collapsible bag is configured to be collapsed longitudinally to a predetermined length defined by the plurality of coupling modules such that the aperture is located at a new distal end, and to be releasably suspended by the plurality of coupling modules from an assembly comprising the collapsible frame and covering, and at least two of the coupling modules are disposed at the new distal end and configured to be releasably coupled to the assembly at locations configured to maintain tension on the collapsible bag in at least partially opposing radial directions, such that the collapsible bag is positioned to receive an object into the hollow cavity through the aperture, further comprising a thermal insert having a second aperture and extending longitudinally to define a second hollow cavity, wherein the thermal insert is adapted to be inserted within the hollow cavity of the collapsible bag through the aperture thereof such that the thermal insert lines the hollow cavity when the collapsible bag is in the accessory state, and wherein an upper portion of the collapsible bag is configured to be folded down inside the second hollow cavity of the thermal insert when the collapsible bag is in the accessory state.

7. The adaptive multi configuration bag of claim 6, further comprising a closure at the aperture wherein, when the collapsible bag is in the stowage state, the closure is configured to substantially close the aperture over the covering and the collapsible frame, in a collapsed state, when they are received in the hollow cavity.

8. The adaptive multi configuration bag of claim 6, further comprising a collapsible bag extension affixed to the bag and extending longitudinally therefrom, wherein:

the collapsible bag extension provides a second stowage state, and the collapsible bag extension is configured to collapse down such that the bag returns to the first stowage state.

9. The adaptive multi configuration bag of claim 8, further comprising a closure at a distal end of the collapsible bag extension wherein, when the collapsible bag is in the second stowage state, the closure is configured to substantially close the aperture over the covering and the collapsible frame, in a second collapsed state, when they are received in the hollow cavity.

10. The adaptive multi configuration bag of claim 6, wherein the collapsible bag is transitioned from the stowage state to the accessory state by folding the bag down longitudinally inside the hollow cavity.

11. The adaptive multi configuration bag of claim 6, wherein, when the collapsible bag is in the accessory state, at least one coupling module is positioned at a top portion of the bag and at least one coupling module is positioned at a bottom portion of the bag.

12. The adaptive multi configuration bag of claim 6, wherein, when the collapsible bag is in an accessory state, a first coupling module is positioned at a top portion of the bag and a second coupling module is positioned at a bottom portion of the bag.

13. The adaptive multi configuration bag of claim 6, further comprising at least one fastening mechanism configured to releasably couple a coupling module to at least one of: the frame and the covering.

14. The adaptive multi configuration bag of claim 6, wherein:

the thermal insert is configured to be stored within the collapsible bag when the collapsible bag is in the stowage state, the thermal insert being inserted within the hollow cavity, and at least one of: the collapsible frame, the cover, and some combination thereof, is at least partially received within the second hollow cavity of the thermal insert.

15. The adaptive multi configuration bag of claim 6, in combination with an inflatable core, the inflatable core comprising:

an inflatable bladder section having a substantially flat profile when in a deflated state, a valve configured to permit selective fluid communication between an interior of the bladder and external ambient fluid medium, and at least one fastening mechanism configured to releasably couple the inflatable core to an object.

16. The adaptive multi configuration bag of claim 6, in combination with a fluid filtering insert, the fluid filtering insert comprising:

a fluid reservoir section;

an outlet in communication between the fluid reservoir section and an exterior of the fluid filtering insert;

an inlet configured to permit fluid into the fluid reservoir section; and at least one fastening mechanism configured to releasably couple the fluid filtering insert to another object.

* * * * *